US007298856B2

(12) United States Patent
Tajima et al.

(10) Patent No.: US 7,298,856 B2
(45) Date of Patent: Nov. 20, 2007

(54) CHIP MICROPHONE AND METHOD OF MAKING SAME

(75) Inventors: Toshifumi Tajima, Tokyo (JP); Toshiyuki Nishiguchi, Tokyo (JP); Nobuo Saito, Tokyo (JP); Akira Morita, Tokyo (JP)

(73) Assignee: Nippon Hoso Kyokai, Tokyo (JP)

( * ) Notice: Subject to any disclaimer, the term of this patent is extended or adjusted under 35 U.S.C. 154(b) by 1220 days.

(21) Appl. No.: 10/235,044

(22) Filed: Sep. 3, 2002

(65) Prior Publication Data

US 2003/0063762 A1 Apr. 3, 2003

(30) Foreign Application Priority Data

Sep. 5, 2001 (JP) ..... 2001-268520
Sep. 25, 2001 (JP) ..... 2001-291824

(51) Int. Cl.
*H04R 3/00* (2006.01)

(52) U.S. Cl. ..... 381/111; 381/175

(58) Field of Classification Search ..... 381/111, 381/175, 173, 174, 190, 191
See application file for complete search history.

(56) References Cited

U.S. PATENT DOCUMENTS 4,558,184 A * 12/1985 Busch-Vishniac et al. .. 381/174
6,088,463 A * 7/2000 Rombach et al. ..... 381/174
6,732,588 B1 * 5/2004 Mullenborn et al. ..... 73/715
2005/0013455 A1 * 1/2005 Loeb et al. ..... 381/191

FOREIGN PATENT DOCUMENTS

JP 6217396 8/1994

OTHER PUBLICATIONS

J. Bergqvist, F. Rudolph, "A silicon condenser microphone using bond and etch-back technology," Sensors and Actuators A, 45 (1994), pp. 115-124.

Altti Torkkeli, Outi Rusanen, Jaakko Saarilahti, Heikki Seppa, Hannu Sipola, Jarmo Hietanen, "Capacitive microphone with low-stress, polysilicon membrane and high-stress polysilicon backplate", Sensors and Actuators, 85 (2000), pp. 116-123.

* cited by examiner

*Primary Examiner*—Stella Woo
(74) *Attorney, Agent, or Firm*—Ladas & Parry LLP

(57) ABSTRACT

A chip microphone implemented as a single silicon-based chip includes a diaphragm which includes a vibration portion that vibrates in response to sound pressures, a support block which is formed on the diaphragm, excluding at least the vibration portion to provide a vibration space, and a back plate which is formed on the support block and over the vibration space, thereby facing the vibration portion of the diaphragm across the vibration space.

31 Claims, 20 Drawing Sheets

CHIP MICROPHONE AND METHOD OF MAKING SAME

BACKGROUND OF THE INVENTION

1. Field of the Invention

The present invention generally relates to microphones and apparatuses based on the use of microphones, and particularly relates to condenser microphones and apparatuses based on the use of such microphones.

2. Description of the Related Art

Technology has been making progress in terms of reducing the size and weight of electrical equipment, and sound processing apparatuses such as portable recorders and cellular phones are not an exception. Such sound processing apparatuses typically employ condenser microphones, which are comprised of two plates, i.e., a diaphragm and a back plate.

Microphones of this kind provide superior performance in terms of sensitivity and noise robustness, and are suitable for size reduction. The diaphragm and the back plate are packed in a case with a spacer (support block) placed therebetween, thereby being provided as a single module, which is then implemented on a circuit board for use in the sound processing apparatus.

Such conventional microphones are manufactured by assembling a plurality of different components, thereby resulting in drawbacks as follows.

Because of the limitations of preciseness during an assembly process, there is an inevitable limit to size reduction. The thickness and circuit area of microphone modules tend to be relatively large, compared to other modules of semiconductor devices implemented on small-size electrical equipment such as cellular phones. This hinders an effort toward increasing the circuit density of circuit boards.

Since the used materials differ from component to component, and thus have different thermal expansion coefficients, distortion may occur due to heat applied during a heat process (more than 200 degrees Celsius) such as a soldering process, which is repeated multiple times during the circuit implementation. Where lead-free solder is used during the circuit implementation process, higher temperature such as in the range from 240° C. to 260° C. need to be taken into consideration.

Further, if components based on resin materials are employed for the diaphragm and the spacer insulator, for example, these components cannot be treated with other components during a high-temperature implementation process such as the bump/reflow process. This results in inability to pursue efficiency.

Accordingly, there is a need for a microphone that is formed as a silicon-based chip, thereby achieving size reduction, cost reduction, and sufficient reliability.

SUMMARY OF THE INVENTION

It is a general object of the present invention to provide a microphone and apparatuses including such a microphone that substantially obviate one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a microphone and apparatuses particularly pointed out in the specification in such full, clear, concise, and exact terms as to enable a person having ordinary skill in the art to practice the invention.

To achieve these and other advantages and in accordance with the purpose of the invention, as embodied and broadly described herein, a chip microphone implemented as a single silicon-based chip according to the invention includes a microphone capsule which includes a vibration portion that vibrates in response to sound pressures a support block which is formed on the diaphragm, excluding at least the vibration portion to provide a vibration space, and a back plate which is formed on the support block and over the vibration space thereby facing the vibration portion of the diaphragm across the vibration space.

The chip microphone as described above can be produced as a small, highly reliable device by use of a micro-machine process technology which utilizes the semiconductor manufacturing technology. When the diaphragm and the back plate are made of silicon-based materials, the chip microphone will exhibit strong heat-resistant characteristics, allowing the use of a process. The microphone can withstand repeated exposures to the heat of reflowing or the like at the time of implementation on a circuit board or implementation as a module. Without the assembly of several parts, the present invention can produce a chip microphone having small area size and a thickness of less than 1 mm, and can implement all circuit components at once on the circuit board by use of an implementation process such as the bump/reflow process. The device for inputting sound information formed in this manner does not limit a temperature range in which the apparatus is used. Even if aluminum, which is typically used, is employed as an electrode material, the chip microphone will exhibit heat-resistant characteristics up to 300 degrees Celsius. The heat-resistant characteristics of this degree can withstand an implementation process using lead-free solder. Preferably, the electrode material is such a material as exhibiting a proper ohmic contact with substrate materials such as silicon.

According to another aspect of the present invention, a sound processing apparatus includes a microphone of a condenser type, and an oscillation/modulation circuit which includes an LC oscillation circuit that oscillates at oscillation frequency determined by a coil and a condenser, the microphone serving as the condenser, wherein the microphone is a silicon-based chip, including a microphone capsule which includes a vibration portion that vibrates in response to sound pressures, a support block which is formed on the diaphragm, excluding at least the vibration portion to provide a vibration space, and a back plate which is formed on the support block and over the vibration space, thereby facing the vibration portion of the diaphragm across the vibration space.

In the sound processing apparatus as described above, the vibration of the diaphragm in the microphone can be detected as changes in the capacitance by applying a small voltage to the LC oscillation circuit, rather than by applying a bias voltage as in conventional microphones. The microphone and the LC oscillation circuit can be formed in the same substrate. With this provision, the present invention can avoid the diaphragm and the back plate being stuck together due to the applied voltage even if the support block is formed to have a thickness as thin as 1 micrometer to 20 micrometers. This further contributes to the size reduction.

According to another aspect of the present invention, a sound processing apparatus includes an array microphone which includes an array of microphones, and an in-phase summation circuit which is connected to the array microphone to add outputs from the microphones together, wherein the array microphone is implemented as a silicon-based device, and each of the microphones included in the array microphone includes a diaphragm which includes a vibration portion that vibrates in response to sound pressures, a support block which is formed on the diaphragm, excluding at least the vibration portion to provide a vibration space, and a back plate which is formed on the support block and over the vibration space, thereby facing the vibration portion of the diaphragm across the vibration space.

In the sound processing apparatus as described above, the outputs of the chip microphones are added together based on the assumption that they are in phase, thereby making it possible to provide a sound input unit that is small and has low-noise characteristics. Production of the sound processing apparatus as a unit makes it possible to achieve steady characteristics of the chip microphones, small product variation, thereby providing a highly-accurate small-size audio input unit.

According to another aspect of the present invention, a method of making a chip microphone includes the steps of providing a diaphragm substrate, providing a back-plate substrate, bonding the diaphragm substrate and the back-plate substrate together with a bonding layer placed therebetween, forming etching masks on exposed surfaces of the diaphragm substrate and the back-plate substrate, performing first etching to turn the diaphragm substrate into a diaphragm and a base around the diaphragm and to turn the back-plate substrate into a back plate having through holes, and performing second etching by using the back plate having through holes as an etching mask to remove a portion of the bonding layer, thereby creating a space across which the diaphragm faces the back plate.

In the method as described above, the two substrates are bonded together after depositing the bonding layer on the bonding surface of the diaphragm substrate or the bonding surface of the back-plate substrate. Through application of a heat process, for example, the present invention bonds the substrates together with steady bonding over the entire surface, while simultaneously providing an insulating layer having a desired thickness between the two substrates. The bonding layer may contain soot silicon oxide as a main component, thereby making it possible to eliminate defects of the oxide film through sufficient infusion of an oxide substance, to bond the substrates without particular needs for the flatness of bonding surfaces and the rigorous control of cleanliness, and to increase latitude in designing the thickness of each of the substrates and the insulating layer compared to the use of direct bonding or the conventional SOI (silicon-on-insulator) technology.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1:
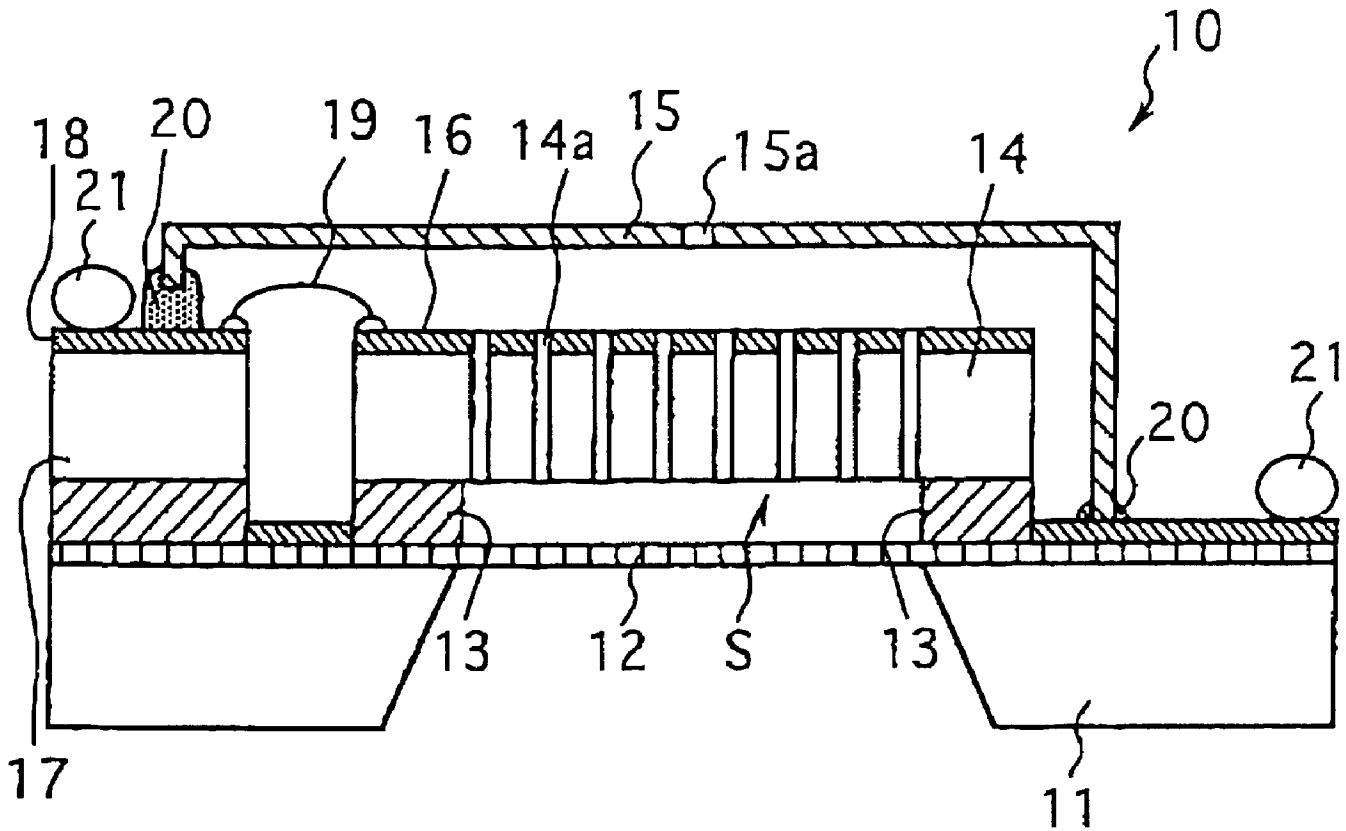
FIG. 1 is an illustrative drawing showing a chip microphone used in a sound processing apparatus according to the present invention.

FIG. 1 is an illustrative drawing showing a chip microphone used in a sound processing apparatus according to the present invention.

In FIG. 1, a chip microphone 10 has a diaphragm 12 formed at the center of a base 11 and vibrating in response to sound pressures, and has a back plate 14 that is supported by a support block 13 around outside the vibrating portion of the diaphragm 12. The back plate 14 thus faces the diaphragm 12, thereby providing a vibration space S for the diaphragm 12. In this manner, the chip microphone 10 is configured to function as a condenser microphone. The chip microphone 10 is manufactured by semiconductor manufacturing technology (i.e., micro-machine processing technology) as will be described later, having a stacked layer structure in which the diaphragm 12, the support block 13, and the back plate 14 are stacked one over another in this order.

The chip microphone 10 has a cap 15 that covers the back plate 14. An electrode 16 formed on the upper surface of the back plate 14 is led to an exterior through a wire bonding electrical connection using a wire 19, which is connected to an electrode 18 on the upper surface of a terminal platform 17 that is formed alongside the back plate 14. The cap 15 is fixedly adhered to the upper surface of the base 11 and to the upper surface of the terminal platform 17 with a ceramics-group adhesive 20 or the like.

The cap 15 serves to adjust, through its size, the acoustic characteristics of the microphone, and also serves as a shield against an electromagnetic field. An air-passage opening 15*a* formed at the center of the cap is used to control the directivity of the microphone. Further, the back plate 14 is provided with a plurality of through holes 14*a* for the purpose of connecting both sides of the back plate 14 so as not to hinder the vibration of the diaphragm 12.

The chip microphone 10 has solder bumps 21, which are formed on the upper surfaces of the base 11 and the terminal platform 17 at positions outside the cap 15. These solder bumps 21 are provided for the purpose of attaching the chip microphone 10 to a module board (not shown) to make a module. This module board is then electrically connected to an implementation board for use in a sound processing apparatus.

In the following, a process of making the chip microphone 10 by semiconductor manufacturing technology will be described.

FIGS. 2A through 2E are illustrative drawings showing a process of making a chip microphone 10.

Figure 2A:
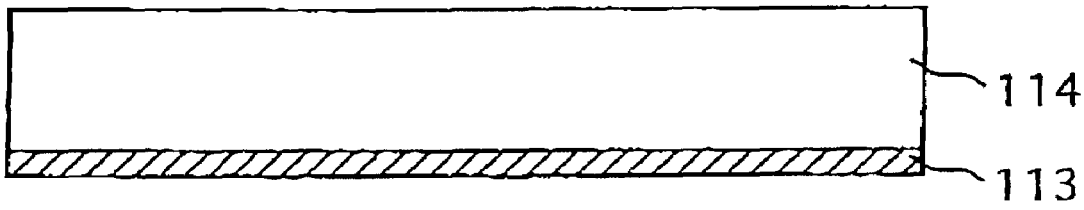
FIGS. 2A through 2E are illustrative drawings showing a process of making the chip microphone.
Figure 2B:
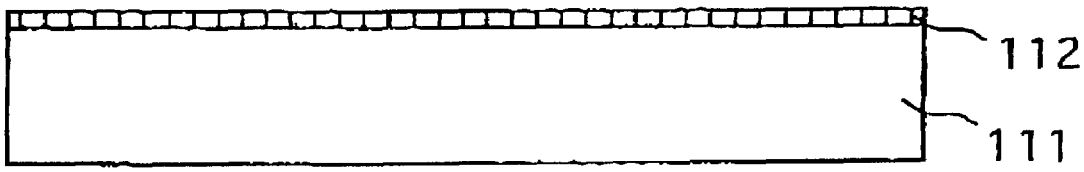

As shown in FIG. 2A, a silicon substrate, generally used as a semiconductor substrate, is provided as a back-plate substrate 114. Beneath the lower surface of the back-plate substrate 114, a bonding film 113 with impurity is formed by a deposition method such as the CVD (chemical vapor deposition) method that deposits an oxide film or by coating with soot silicon oxide containing impurity therein. By the same token, as shown in FIG. 2B, a silicon substrate is provided as a diaphragm substrate 111. At the upper surface of the diaphragm substrate 111, an etch-stop layer 112 with high impurity concentration is formed by a solid phase diffusion method that provides the silicon substrate with the high concentration of impurity through thermal diffusion.

The etch-stop layer 112 and the bonding film 113 are provided with the same type of impurity so as to have similar physical property. In order to stop impurity from diffusing from the etch-stop layer 112 to the bonding film 113, the bonding film 113 is designed to have higher impurity concentration than the impurity concentration of the etch-stop layer 112.

The etch-stop layer 112 will be turned into the diaphragm 12 as thin as few microns so as to provide high sensitivity for the condenser microphone. To this end, it is preferable to diffuse boron as impurity for the purpose of avoiding the etching of the etch-stop layer 112 at a subsequent etching stage. It follows that the bonding film 113 is also provided with boron as impurity, which is diffused by the solid phase diffusion process to a high concentration. In order to achieve the high concentration of impurity through the thermal diffusion, high temperature is required. Use of temperature less than 1200 degrees Celsius will prevent the silicon wafer from suffering heat-caused distortion. In this example, a description has been given with reference to a case in which the solid phase diffusion method is used as a means to form the etch-stop layer 112. Needless to say, however, other methods such as an ion implantation method or a coating method may also be used, and the impurity is not limited to boron.

Figure 2C:
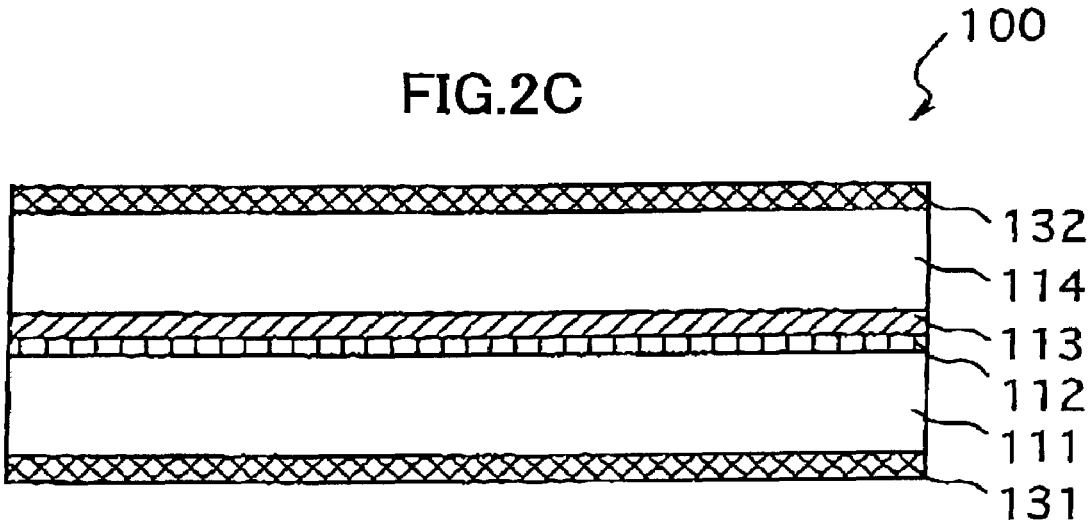

As shown in FIG. 2C, the bonding film 113 and the etch-stop layer 112 are bonded together by use of bonding technology such as thermal bonding, anodic bonding, or direct bonding, thereby forming a bonded substrate 100 comprised of the back-plate substrate 114 and the diaphragm substrate 111 bonded together. The upper surface of the back-plate substrate 114 is ground to adjust the thickness of the whole substrate. The bonded substrate 100 is then subjected to heat in the oxygen atmosphere, so that oxide films 131 and 132 serving as etching masks are formed on the upper and lower surfaces of the bonded substrate 100. The thickness of the oxide films 131 and 132 is set to around 4000 angstroms by taking into account the depth of silicon etching of the diaphragm substrate 111. The heat process for forming the oxide films 131 and 132 is preferably performed at lower temperature than when the etch-stop layer 112 was formed, the purpose being to avoid the diffusion of impurity of the etch-stop layer 112. In this embodiment, temperature used for forming the oxide films 131 and 132 is set to 900 degrees Celsius that is lower than the temperature used for forming the etch-stop layer 112. Such temperature is chosen by taking into account a need to secure a proper growth rate of the oxide films 131 and 132 and also taking into account the fact that the use of lower temperature will results in an increase of interface charge between the diaphragm substrate 111 and the bonding film 113.

Figure 2D:
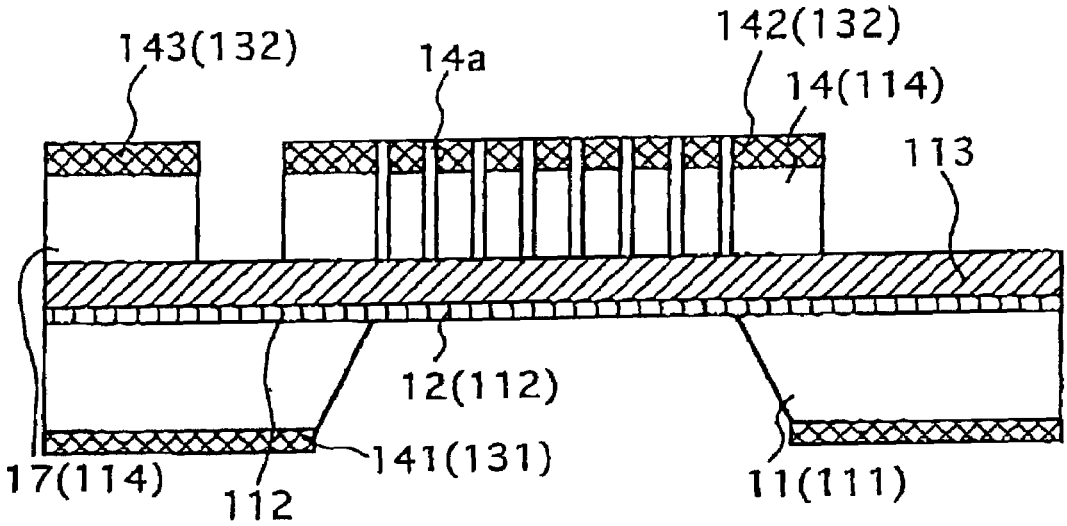

As shown in FIG. 2D, photolithography is employed to remove unnecessary portions of the oxide films 131 and 132 from the bonded substrate 100, thereby turning the oxide film 131 into a diaphragm etching mask 141 and turning the oxide film 132 into a back-plate etching mask 142 and a terminal-platform etching mask 143, followed by etching the diaphragm substrate 111 and the back-plate substrate 114 to remove unnecessary portions thereof through the etching masks 141-143. In this manner, the diaphragm substrate 111 is turned into the base 11, exposing the etch-stop layer 112 that forms the diaphragm 12, and making the back-plate substrate 114 into the back plate 14 and the terminal platform 17. Such etching may be performed by use of an alkali etching solution such as TMAH (tetramethyl ammonium hydroxide).

Figure 2E:
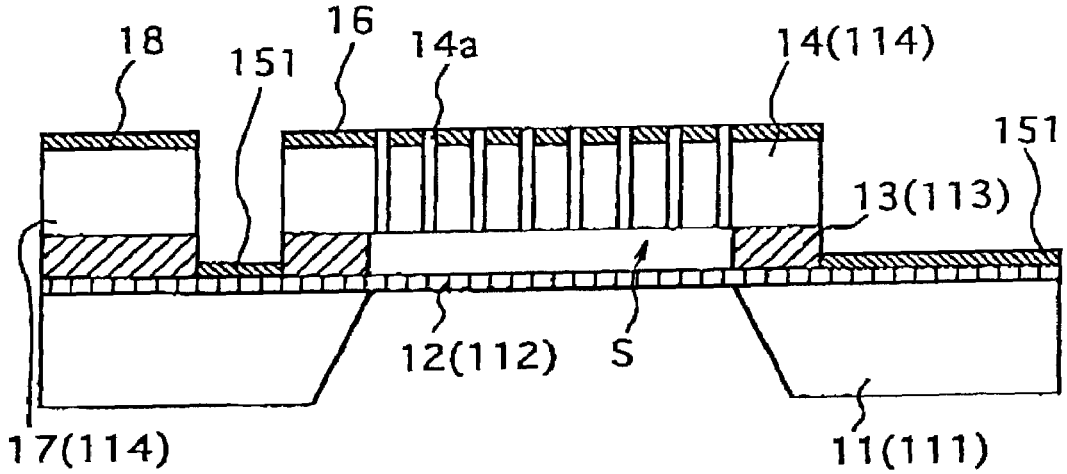

As shown in FIG. 2E, the etching masks 141 through 143 are removed by etching, and portions of the bonding film 113 other than the support block 13 are also removed by etching. The thin-metal electrodes 16 and 18 are formed by sputtering or the like on the upper surfaces of the back plate 14 and the terminal platform 17, thereby making the chip microphone 10 having an integrated structure. The electrodes 16 and 18 are shown as thick films for the sake of illustration, but can sufficiently be thin films, so that there is no need to use a deposition mask, except for the back plate 14 and the terminal platform 17. For example, the formation of a thin film 151 on the upper surface of the etch-stop layer 112 does not cause any harm. Although a detailed description of an electrode for the diaphragm 12 is not particularly given here, such an electrode may well be formed by use of sputtering or the like. Here, the use of the deposition mask may be omitted, thereby generating both electrodes simultaneously.

The electrode 16 on the back plate 14 and the electrode 18 on the terminal platform 17 are connected together through wire bonding, and the cap 15 is adhered by using the ceramics-group adhesive 20 or the like. The solder bumps 21 are then formed on the thin film 151 over the base 11 and on the electrode 18 over the terminal platform 17. The chip microphone 10 formed in this manner can be mounted on a module substrate to make a module structure, which may be implemented on a microphone-circuit substrate for use in audio processing apparatus.

In the embodiment as described above, the chip microphone 10 can be made as a single chip by forming a high-precision stacked-layer structure comprised of the diaphragm 12, the support block 13, and the back plate 14 based on the semiconductor manufacturing technology. Use of the semiconductor manufacturing technology achieves low cost and easy manufacturing of the chip microphones. The chip microphone 10 together with other components can then be implemented on a circuit substrate with high circuit density as part of CSP (chip size packaging). Since the diaphragm 12, the support block 13, and the back plate 14 are made of silicon-based materials, differences in thermal expansion coefficients are small, resulting in little likelihood of heat-caused distortion. It is therefore less likely to have the diaphragm 12 damaged. Because of such heat-resistant characteristics, a high-temperature process can be applied at various manufacturing steps. Efficient manufacturing is thus achieved by utilizing high-temperature temperature reflowing or the like at the time of module formation or implementation on the circuit substrate.

Accordingly, the chip microphone 10 is provided as a reliable and inexpensive component having small area size and a thickness of less than 1 mm like a LSI chip, rather than being manufactured by assembling a plurality of components including a diaphragm, a support block, and a back plate. Further, efficient manufacturing can be achieved by utilizing the bump/reflow process to implement all at once on the circuit substrate.

The present invention thus contribute to size reduction, cost reduction, and reliability of audio processing apparatus such as circuit boards or cellular phones having the chip microphone 10 implemented thereon.

Although the diaphragm 12, the support block 13, the back plate 14 are made of the same silicon-based material in this embodiment, the type of material is not limited to be silicon-based. Further, different types of substrate materials may be bonded together as long as the diaphragm 12 and the support block 13 are made of materials having similar physical property in terms of thermal expansion coefficients and the like.

In what follows, a description will be given with regard to an audio recording apparatus according a first embodiment of a sound processing apparatus of the present invention.

Figure 3:
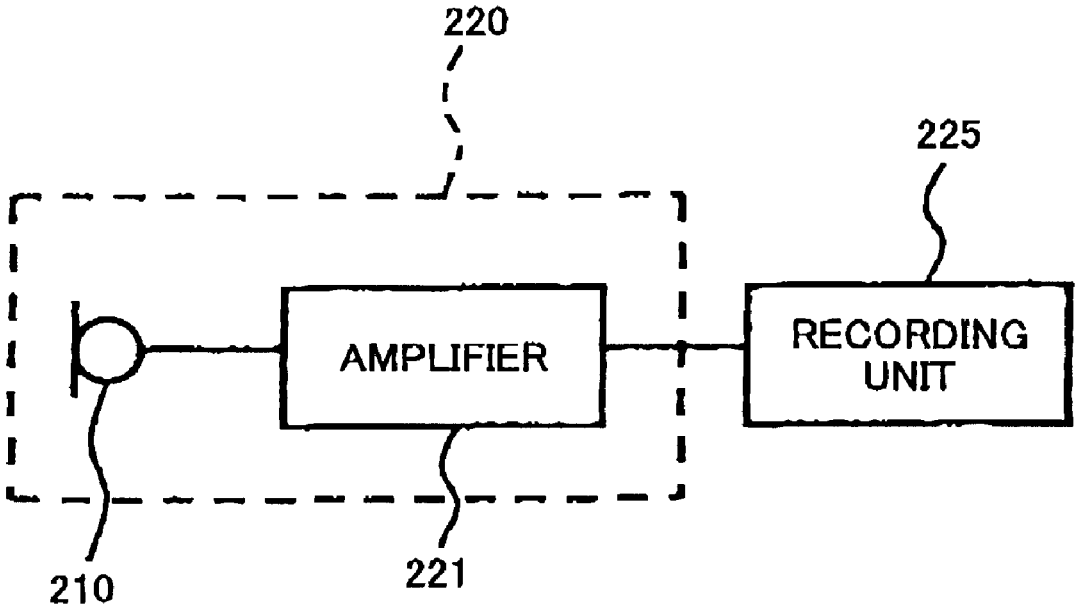
FIG. 3 is a block diagram showing an example of the configuration of an audio recording apparatus according to the first embodiment.

FIG. 3 is a block diagram showing an example of the configuration of the audio recording apparatus according to the first embodiment.

In FIG. 3, the audio recording apparatus (sound processing apparatus) includes an amplifier 221 for amplifying audio information such as human voice received by a chip microphone 210, and further includes a recording unit 225 for recording the amplified audio information. The chip microphone 210 and the amplifier 221 are integrally formed as an IC chip 220 by semiconductor manufacturing technology (micro-machine processing technology), thereby achieving size reduction. The IC chip 220 is directly connected to the recording unit 225 to attain compact size for the entirety of the apparatus.

Figure 4A:
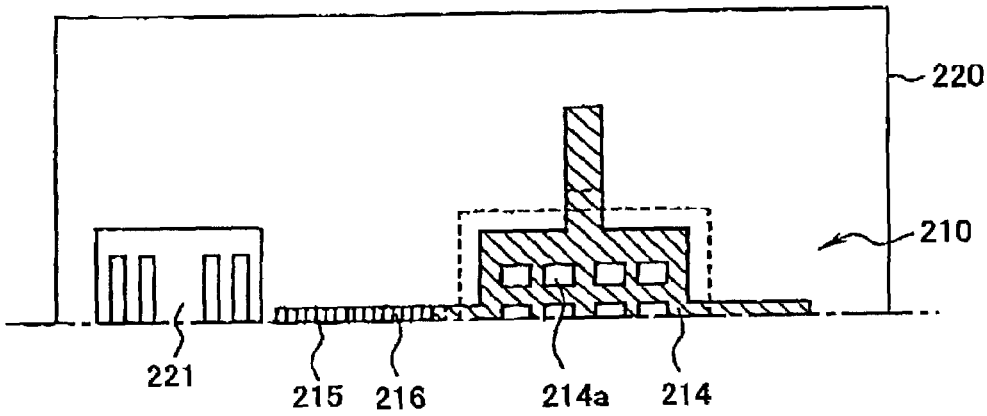
FIGS. 4A and 4B are illustrative drawings showing an example of the configuration of a chip microphone shown in FIG. 3.
Figure 4B:
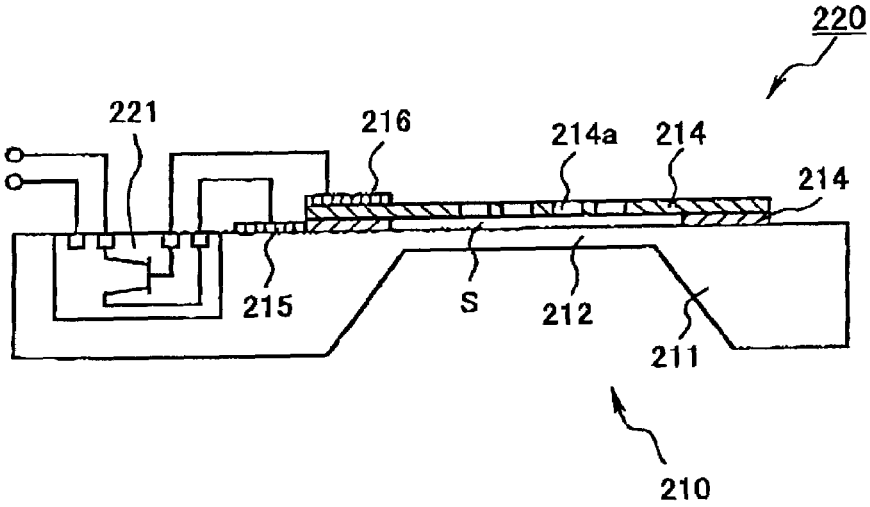

FIGS. 4A and 4B are illustrative drawings showing an example of the configuration of the chip microphone 210.

As shown in FIGS. 4A and 4B, a diaphragm 212 is formed at the center of a base 211 so as to vibrate in response to sound pressures. A back plate 214 is supported by an adhesive support block (adhesive insulating layer) 213 around outside the vibrating portion of the diaphragm 212 so as to provide a vibration space (gap space) S, thereby facing the diaphragm 212. With this provision, the chip microphone 210 is configured to function as a condenser microphone. The chip microphone 210 has a stacked-layer structure in which the diaphragm 212, the adhesive support block 213, and the back plate 214 stacked one after another in this order, so that the chip microphone 210 together with the amplifier 221 can be made by semiconductor manufacturing technology. In FIGS. 4A and 4B, a plurality of through holes 214*a* are formed through the back plate 214 so as not to prevent the vibration of the diaphragm 212.

In the IC chip 220, the diaphragm 212 vibrates in response to sound input into the chip microphone 210, which creates changes in capacitance between the opposing plates, i.e., the diaphragm 212 and the back plate 214. Such changes are picked up by electrode terminals 215 and 216 as analog signals, which are then amplified by the amplifier 221 for outputting.

The chip microphone 210 has a cap that covers the back plate 214, and an air-passage hole is formed at the center of the cap. With this provision, the size of the cap serves to adjust the acoustic characteristics of the microphone. The cap can also serve as a shield for electromagnetic fields, and the air-passage hole at the center of the cap is used to control the directivity of the microphone.

In the following, a process of making the chip microphone 210 by the semiconductor manufacturing technology will be described with reference FIGS. 5A through 5D. As for the amplifier 221, a conventional semiconductor process can be employed for manufacturing thereof, and a description thereof will be omitted.

Figure 5A:
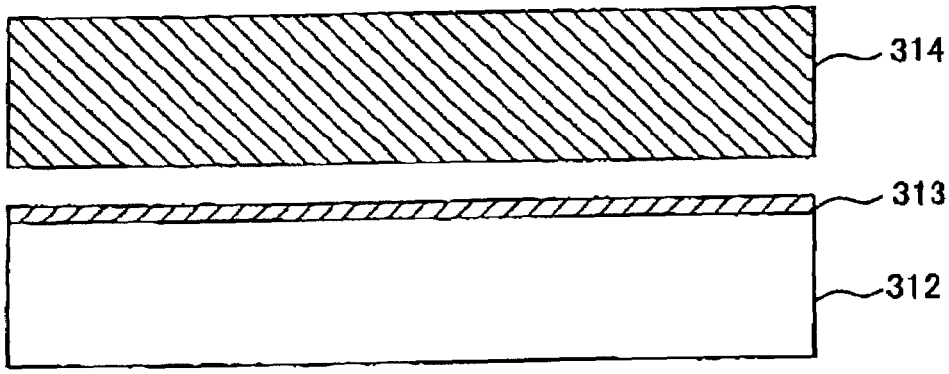
FIGS. 5A through 5D are illustrative drawings showing a process of making the chip microphone by the semiconductor manufacturing technology.

As shown in FIG. 5A, silicon substrates of such a type as generally used as semiconductor substrates are provided as a diaphragm substrate 312 and a back-plate substrate 314. A surface of the diaphragm substrate 312, to which the back-plate substrate 314 is to be bonded (adhered), has an adhesive layer 313 formed by the CVD method or the like to a thickness of 10 micrometers, for example. This adhesive layer 313 has soot silicon oxide as a principal component, and contains the high concentration of boron or phosphorus. For size reduction of the microphone, the thickness of the adhesive layer 313 may be properly 1 to 20 micrometers when considering the ease of manufacturing and a bias potential. The thickness of the adhesive layer 313 is preferably 2 to 5 micrometers when considering sensitivity and frequency characteristics, and may be determined according to a voltage applied thereto in such a manner as to avoid contact between the diaphragm 312 and the back plate 314. The adhesive layer 313 may alternatively be formed on a surface of the back-plate substrate 314.

Figure 5B:
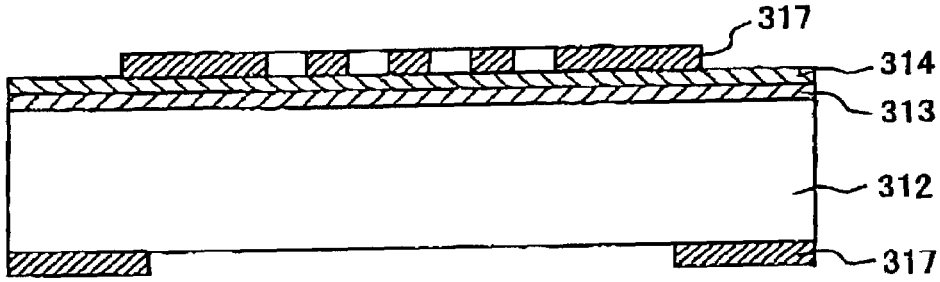

As shown in FIG. 5B, the diaphragm substrate 312 and the back-plate substrate 314 are held together and subjected to heat, so that they are adhered together via the deposited adhesive layer 313. The back-plate substrate 314 is ground to a desired thickness by taking into account its use as the back plate. Oxide layers are then deposited on the lower and upper surfaces of the bonded substrates 312 and 314, followed by a photolithography process being applied thereto to generate etching masks 317.

Figure 5C:
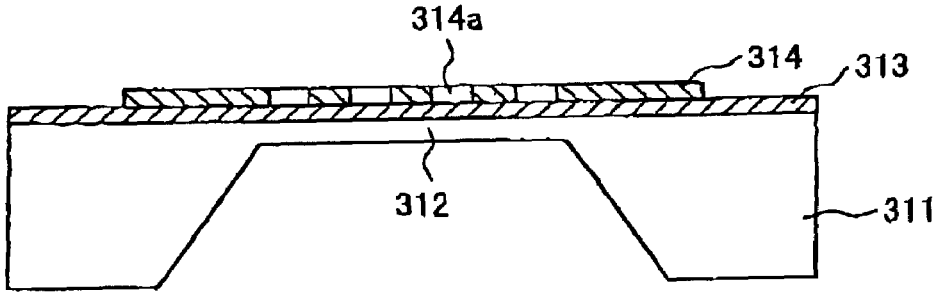

As shown in FIG. 5C, wet etching using an alkali etching solution or dry etching using $XeF_2$ gas is applied to the substrates 312 and 314 through the etching masks 317, thereby forming the back plate 314 and the base 211 having the diaphragm 312. The back plate 314 has a mesh structure with the through holes 314*a* formed at the portion where the diaphragm 312 is situated, the purpose being to release air pressure generated inside the vibration space S by the vibration of the diaphragm 312.

Figure 5D:
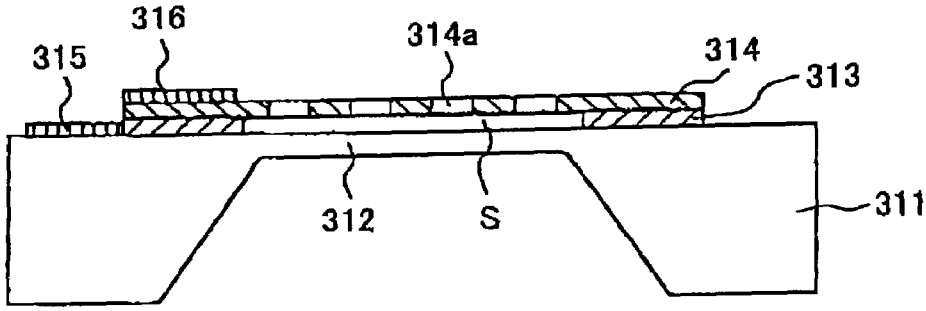

As shown in FIG. 5D, the back plate 214 is used as an etching mask, and the adhesive support block 313 is etched by hydrofluoric acid through the mesh structure of the back plate 214. Through this etching, the adhesive layer 313 is removed, except for the portion corresponding to the adhesive support block 313 near the perimeter of the back plate 314, thereby creating the vibration space S. The electrode terminals 315 and 316 are then formed by vapor deposition that creates a metal film made of aluminum, for example. The chip microphone 210 is thus produced as having an integrated structure.

The adhesive layer 313 has soot silicon oxide as a main component, thereby insuring the sufficient amount of oxide contents that prevent the defects of the oxide layer. Because of this, the diaphragm substrate 312 and the back-plate substrate 314 can be quickly adhered together with sufficient bonding contact over the entire surface, without a need for tight control of surface flatness of these substrates. Further, there is no need to rigorously control cleanliness of the bonding surfaces of these substrates when adhering the substrates 312 and 314 together. It is therefore possible to freely choose the thickness of the substrates 312 and 314, the distribution of impurity concentration, the thickness of the adhesive layer 313, etc., compared with when bonding the substrates 312 and 314 directly. Since the adhesive layer 313 contains high concentration of boron or phosphorus, it is possible to increase fluidity at the time of adhesive contact, thereby improving steady contact at the time of bonding the substrates 312 and 314 together.

The electrode terminals 215 and 216 of the chip microphone 210 are connected to an input terminal of the amplifier 221 by wire bonding or the like, and the output of the amplifier 221 is then connected to the recording unit 225. With this provision, the IC chip 220 functions as an audio input unit for an audio recording apparatus.

In the embodiment described above, the chip microphone 210 is produced by the semiconductor manufacturing technology that does not require any assembling step, such that the adhesive support block 213 placed between the diaphragm 212 and the back plate 214 in the multi-layer structure has soot silicon oxide as a main component together with high concentration of boron or phosphorous, and has a thickness ranging from 1 micrometer to 20 micrometers. This makes it possible to readily produce a high-precision chip product at low costs, thereby manufacturing inexpensive small-size. microphones having uniform characteristics.

The chip microphone 210 is integrally formed together with the amplifier 221 as the IC chip 220, thereby insuring high and reliable quality and achieving the effective implementation of small-size and lightweight products.

Further, since the chip microphone 210 is made of a silicon-based material, it exhibits strong heat-resistant characteristics. It is possible to avoid a situation in which the use of the chip microphone 210 is limited to particular areas of use because of limitations posed by operating temperature.

In the embodiment described above, the diaphragm 212, the adhesive support block 213, and the back plate 214 are made of the same silicon-based material. It should be noted, however, that the material used in the invention does not have to be a silicon-based material.

Figure 6:
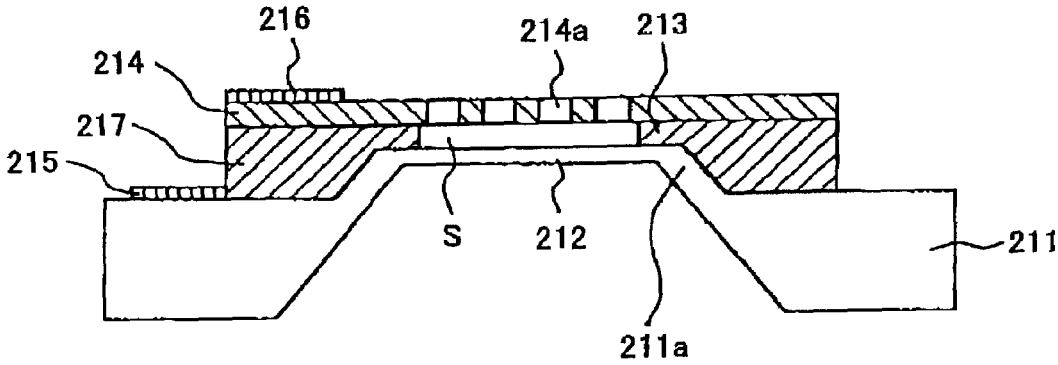
FIG. 6 is an illustrative drawing showing a first variation of the chip microphone of the first embodiment.

FIG. 6 is an illustrative drawing showing a first variation of the chip microphone of the first embodiment. The chip microphone 210 of the first embodiment includes the flat substrates 312 and 314 bonded together with an adhesive, so that a parasitic capacitance created by the opposing electrodes outside the portion where the opposing electrodes function as the diaphragm 212 and the back plate 214 ends up being comparable to the effective capacitance, thereby serving as one of the coefficients to reduce sensitivity when detecting capacitance changes caused by sound pressures. It is not desirable, however, to reduce the area of the relevant portion since the sensitivity of the microphone is proportional to the area of the relevant portion. As shown in FIG. 6, therefore, a step 211*a* is formed as part of the base 211 by raising the portion of the base 211 that directly serves as the diaphragm 212, and a thick adhesive support block 217 is provided around the adhesive support block 213. This configuration further separates the opposing electrodes from each other, thereby reducing the parasitic capacitance and improving sensitivity.

Figure 7:
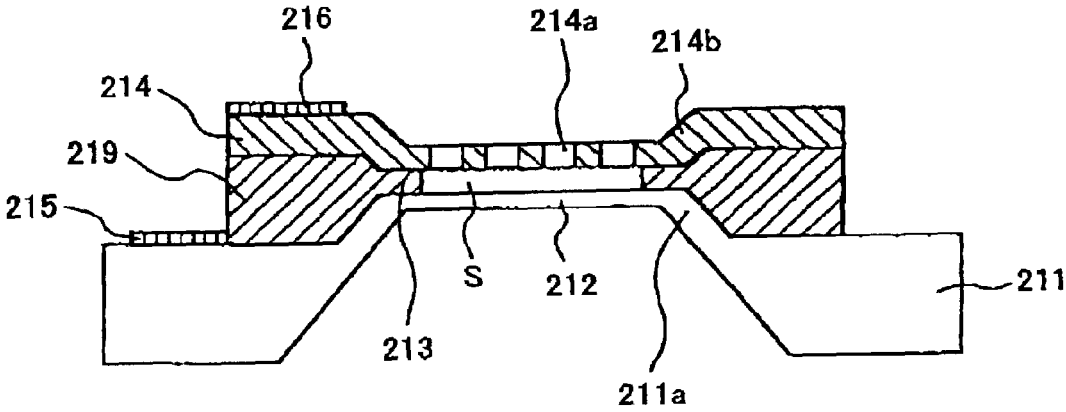
FIG. 7 is an illustrative drawing showing a second variation of the chip microphone of the first embodiment.

FIG. 7 is an illustrative drawing showing a second variation of the chip microphone of the first embodiment. In FIG. 7, a step 214*b* is formed as part of the back plate 214 in addition to the step 211*a* of the base 211 so as to raise a portion of the back plate 214 outside the vibrating portion of the diaphragm 212. Further, a thick adhesive support block 219 is provided around the adhesive support block 213. This configuration further separates the opposing electrodes from each other, thereby reducing the parasitic capacitance and improving sensitivity.

Figure 8:
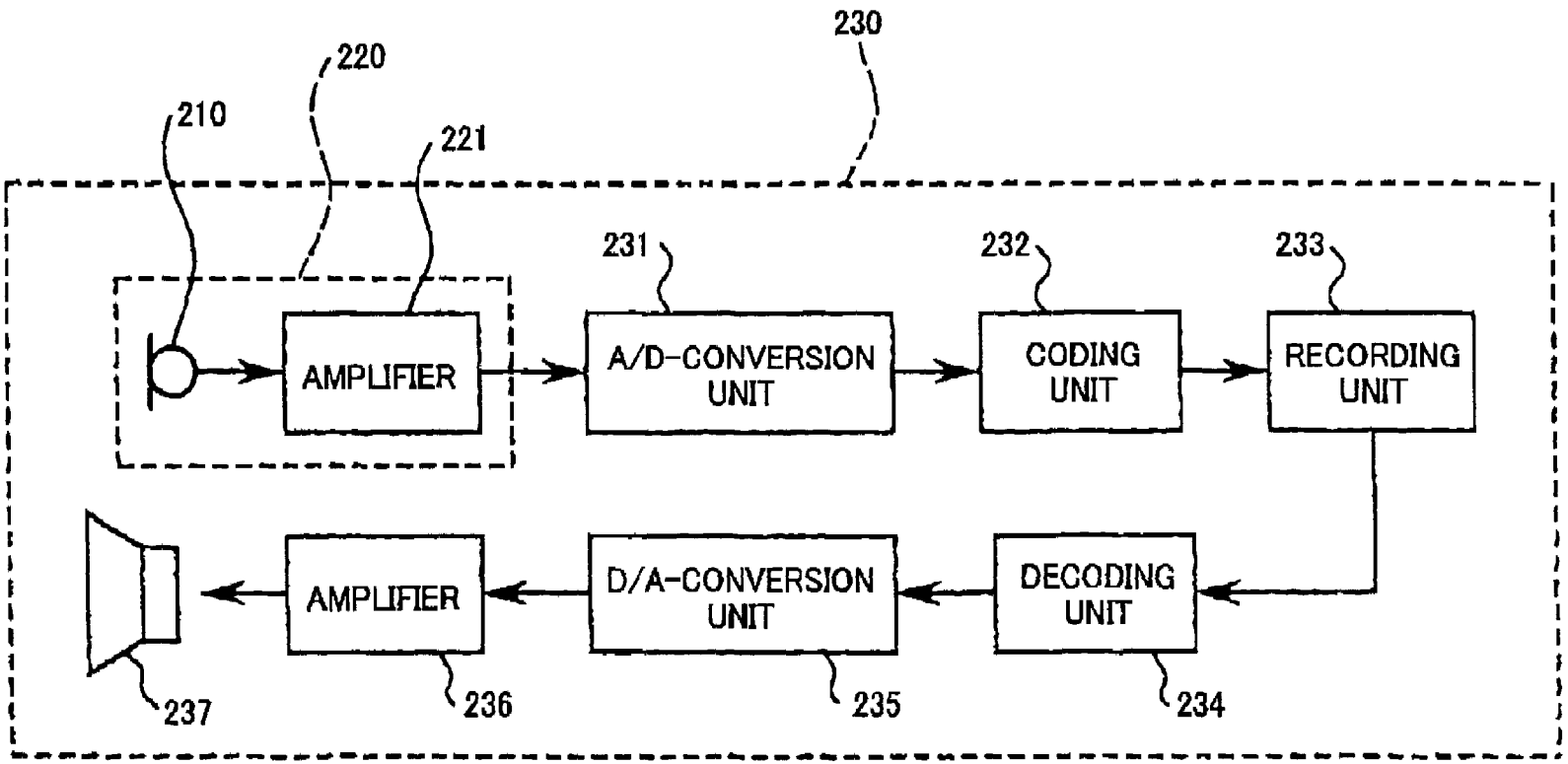
FIG. 8 is a block diagram showing an example of the configuration of an audio recording/reproducing apparatus according a second embodiment of the sound processing apparatus of the present invention.

FIG. 8 is a block diagram showing an example of the configuration of an audio recording/reproducing apparatus according a second embodiment of the sound processing apparatus of the present invention. In the second embodiment, the same elements as those of the preceding embodiment are referred to by the same numerals.

In FIG. 8, the audio recording/reproducing apparatus (sound processing apparatus) is configured to receive audio information by the chip microphone 210 of the IC chip 220, to record digital audio information amplified by the amplifier 221, and to reproduce the recorded audio information. The IC chip 220 is implemented on a circuit substrate 230, together with an A/D-conversion unit 231 for converting analog signals into digital signals as the analog signals are output from the amplifier 221, a coding unit 232 for compressing audio information by coding the digital signals after A/D conversion by the A/D-conversion unit 231, a recording unit 233 for recording audio information in a record medium such as a memory stick or a magneto-optical disc such as an MO disk after coding by the coding unit 232, a decoding unit 234 for decoding the compressed audio information recorded by the recording unit 233, a D/A-conversion unit 235 for converting audio information of digital signals decoded by the decoding unit 234 into analog signals, an amplifier 236 for amplifying the analog signals converted by the D/A-conversion unit 235, and a speaker 237 for reproducing audio sound based on audio information supplied from the amplifier 236. The IC chip 220 may be implemented on the circuit substrate 230 as a packaged module having the cap attached thereto as previously described.

In this manner, the microphone can be implemented on the circuit substrate 230 rather than being implemented as a separate component, allowing the audio recording/reproducing apparatus to be assembled simply by putting the circuit substrate 230 in a case. During the implementation of components on the circuit substrate 230, a high-temperature process can be applied since the IC chip 220 is made of a silicon-based material that exhibits strong heat-resistant characteristics. The implementation of circuit components onto the circuit substrate 230 can thus be performed all at once by use of the bump/reflow process that requires the use of intensive heat. Further, since the IC chip 220 uses aluminum electrodes for the chip microphone 210, a high-temperature implementation process that uses lead-free solder can also be employed.

In this embodiment, further, the implementation of the IC chip 220 together with the other components 231 through 237 on the circuit substrate 230 can be performed with high component density by use of the CSP (chip size packaging) method or the like. In this case also, the bump/reflow process can be applied all at once so as to achieve effective assembling on the circuit substrate 230. This contributes to size reduction, cost reduction, and high reliability of the audio recording/reproducing apparatus.

Figure 9:
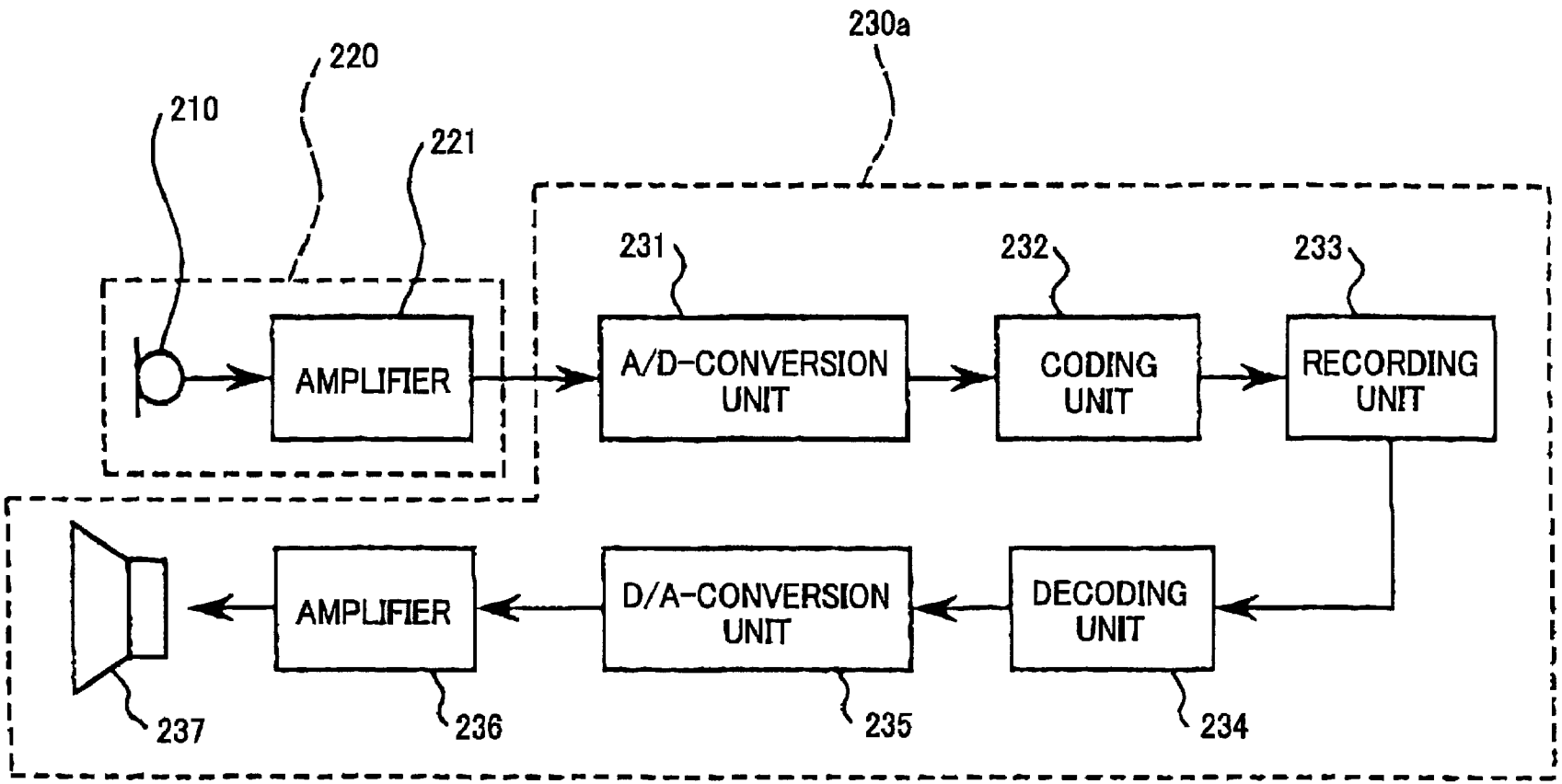
FIG. 9 is a block diagram showing another variation of the audio recording/reproducing apparatus.
Figure 10:
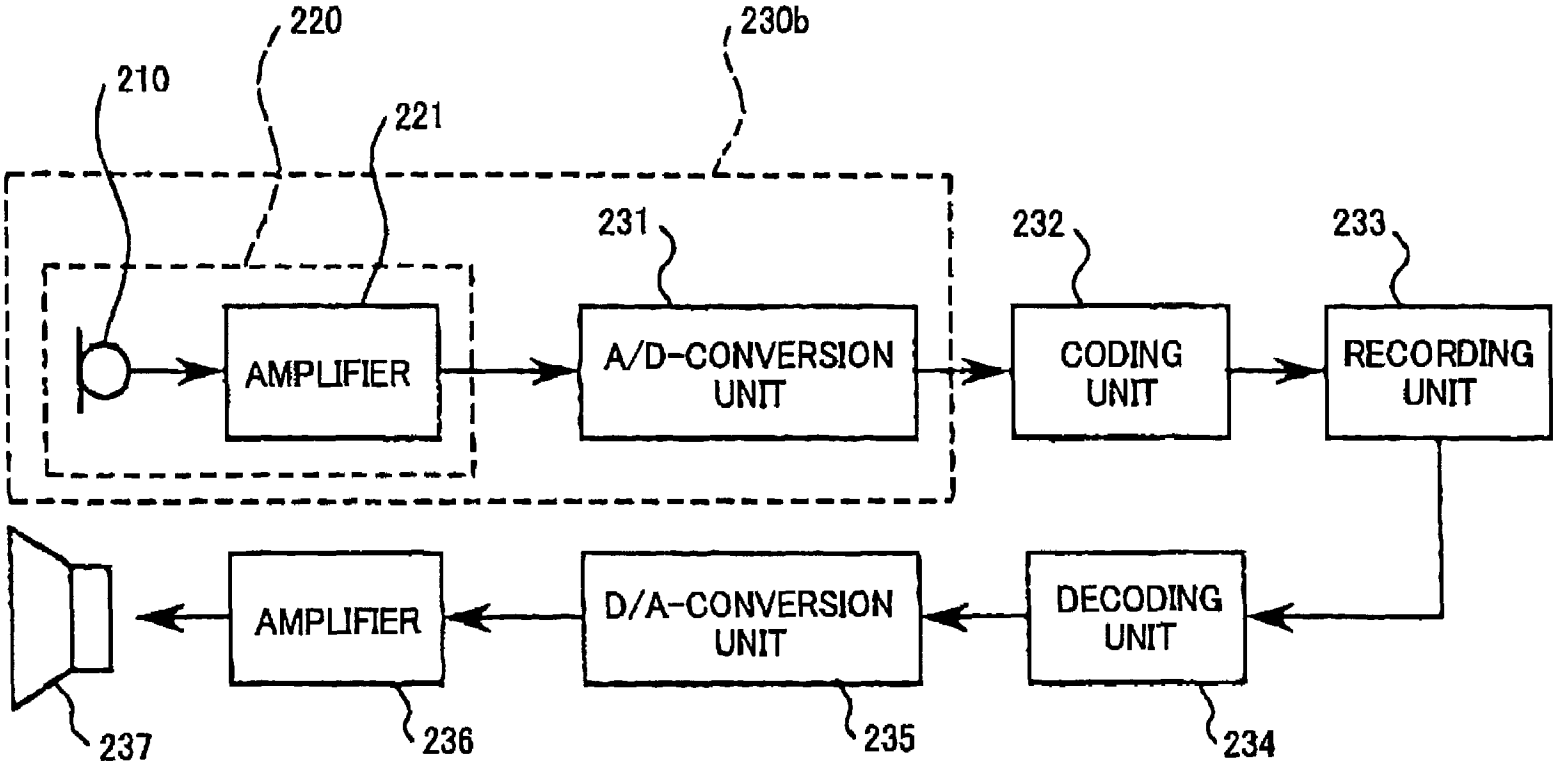
FIG. 10 is a block diagram showing yet another variation of the audio recording/reproducing apparatus.
Figure 11:
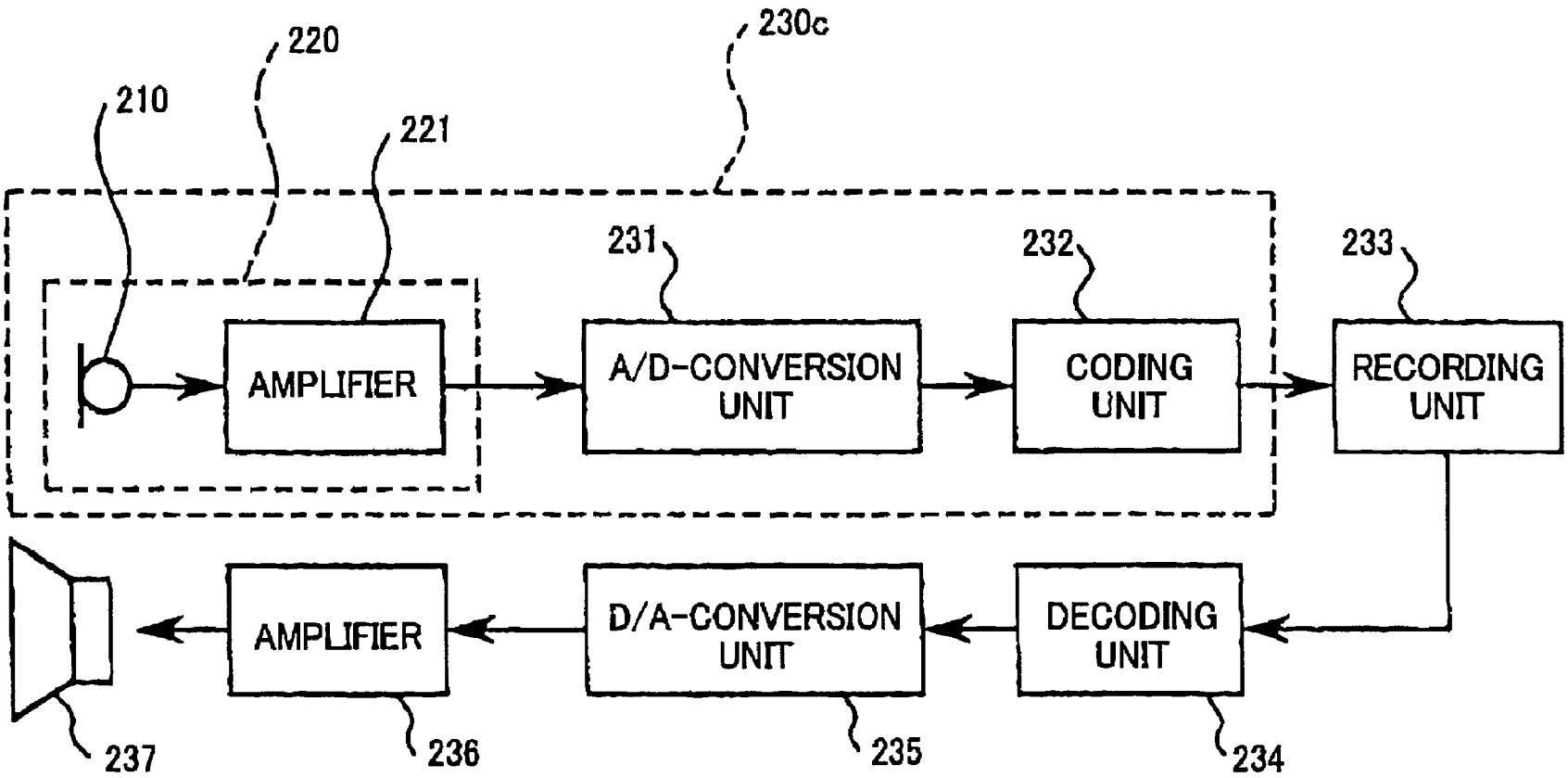
FIG. 11 is a block diagram showing still another variation of the audio recording/reproducing apparatus.

As shown in FIG. 9, another variation of this embodiment may be configured such that the IC chip 220 may be connected through signal lines to a circuit substrate 230*a* on which the components 231 through 237 are implemented. As shown in FIG. 10, further, the IC chip 220 and the A/D-conversion unit 231 may be implemented on a circuit substrate 230*b* with an aim of avoiding the reduction of the S/N ratio of audio outputs. As shown in FIG. 11, moreover, the IC chip 220, the A/D-conversion unit 231, and the coding unit 232 are implemented on a circuit substrate 230*c*, thereby making a stage preceding the recording unit 233 as a single unit so as to simplify the assembling of the apparatus. Any one of these variations may be chosen at the time of design by taking into account an exterior shape, functions, limitations imposed by manufacturing steps, etc.

Figure 12:
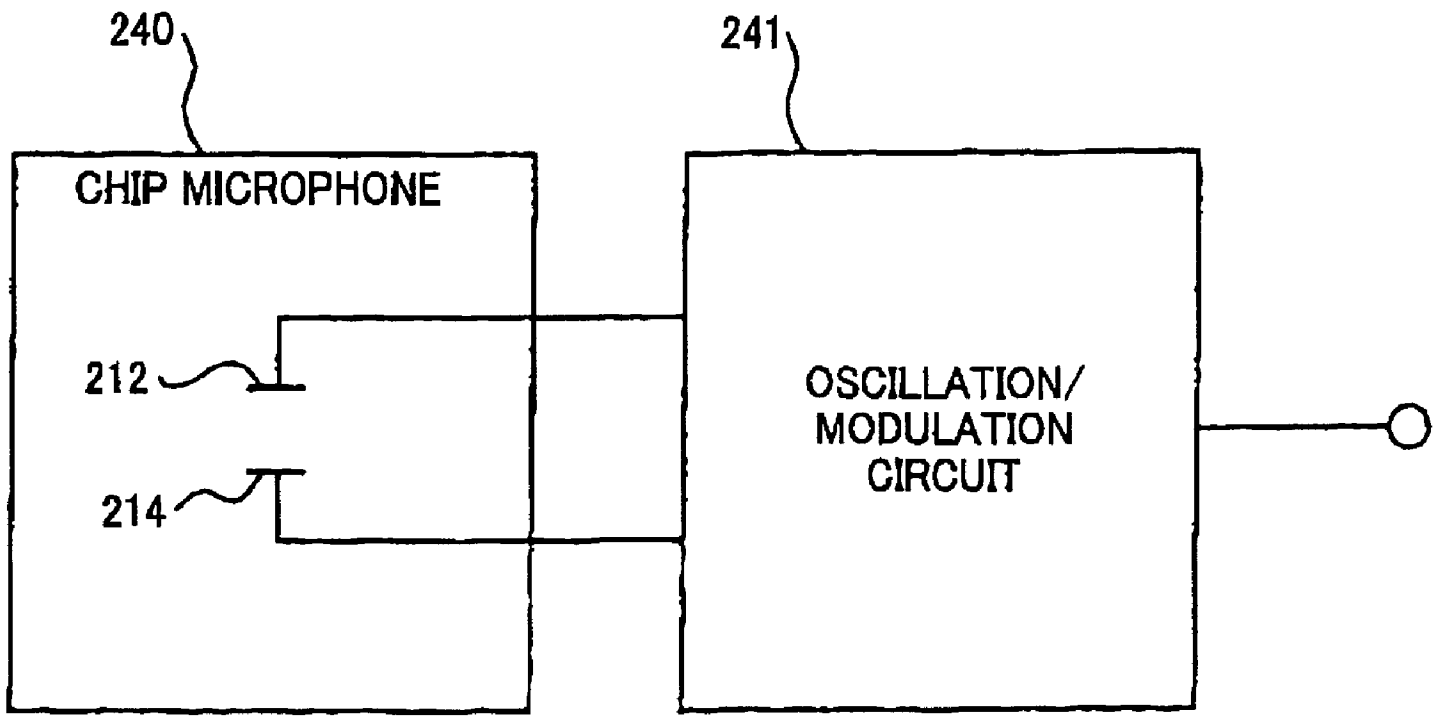
FIG. 12 is a diagram showing an example of an audio pickup apparatus according to a third embodiment of the sound processing apparatus of the present invention.
Figure 13:
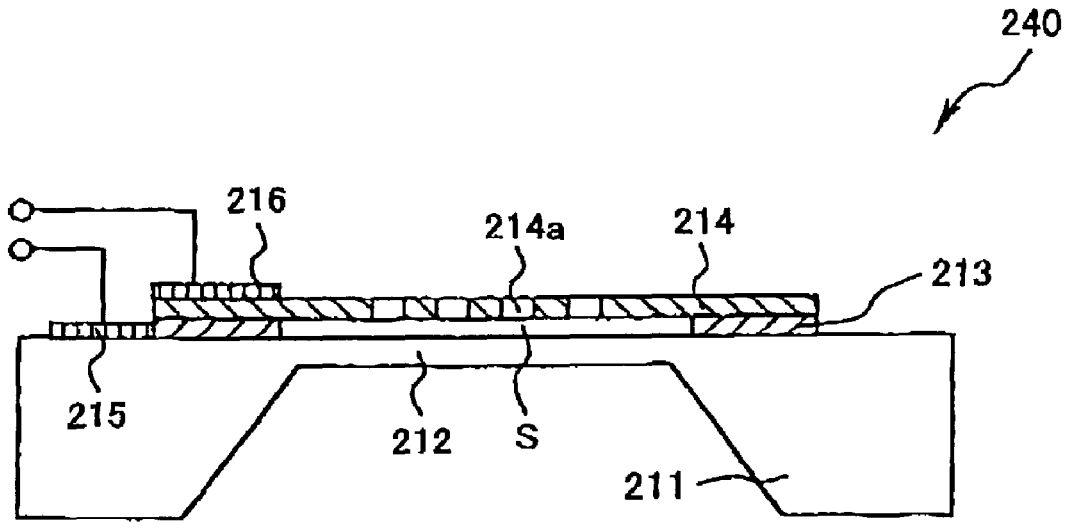
FIG. 13 is an illustrative diagram showing an example of the configuration of a chip microphone shown in FIG. 12.

FIG. 12 is a diagram showing an example of an audio pickup apparatus according to a third embodiment of the sound processing apparatus of the present invention. FIG. 13 is an illustrative diagram showing an example of the configuration of a chip microphone shown in FIG. 12.

In FIG. 12 and FIG. 13, a chip microphone 240 is configured to function as a condenser microphone by placing the adhesive support block 213 between the diaphragm 212 formed of the base 211 and the back plate 214 having the plurality of through holes 214*a*.

The chip microphone 240 is a condenser comprised of the thin, flat diaphragm 212 and the back plate 214. In order to provide more sensitive detection of changes in the condenser capacitance caused by the vibration of diaphragm 212 responding to changes in sound pressures, the following measures may be taken: (1) increasing a bias voltage; (2) decreasing a gap between the diaphragm 212 and the back plate 214; (3) increasing the plate areas of the diaphragm 212 and the back plate 214; and (4) using a softer material for the diaphragm 212 (i.e., reducing the stiffness of the diaphragm 212. It should be noted, however, that in the chip microphone 240, there is a need to insure that the diaphragm 212 and the back plate 214 do not touch each other through the electrostatic attracting force. A guidance to make the diaphragm 212 and the back plate 214 function without touching each other is provided as a stability factor μ in Akio Mizoguchi, "Design of Miniaturizing Directional Condenser Microphone", Journal of the Acoustical Society of Japan, Vol. 31, No. 10, pp. 593-601 (1975). In general, a design is made by choosing μ that is approximately 7.

$$\mu = \frac{d^3 s_m}{\varepsilon_o S V_o^2} \tag{1}$$

d: distance between diaphragm and back plate

S: area of back plate 214

$s_m$: stiffness of diaphragm $\in_a$: dielectric constant of air $V_b$: bias voltage According to the equation (1), the measures (1) through (4) mentioned above for improving the sensitivity of the chip microphone 240 act against the improvement of stability. Since the chip microphone 240 has an extremely minute gap of few micrometers between the diaphragm 212 and the back plate 214, there is a limit to the sensitivity that can be achieved.

The audio pickup apparatus of this embodiment directly connects the chip microphone 240 to an oscillation/modulation circuit 241 of an LC oscillation circuit as part or all of the condenser capacitance of the oscillation/modulation circuit 241, without placing an intervening amplifier as in the first embodiment described above. With this provision, changes in the condenser capacitance between the opposing plates of the diaphragm 212 and the back plate 214 responding to audio information are picked up as changes in the oscillation frequency of the LC circuit. The picked-up changes are then output from the output terminal of the oscillation/modulation circuit 241 to an exterior thereof The LC oscillation circuit is an oscillator that has an oscillation frequency determined by a coil and a condenser, and detects changes in the condenser capacitance as changes in the oscillation frequency. According to this technology, there is no need to apply a bias voltage to the condenser portion of the chip microphone 240, thereby increasing latitude in selecting a measure for improving sensitivity. In this case, the condenser portion of the chip microphone 240 receives a minute voltage no more than necessary for operating the oscillator of the oscillation/modulation circuit 241, which is far lower than the bias voltage applied in the case of an ordinary microphone. It is thus possible to significantly increase the stability factor μ of the equation (1), thereby making it less likely that the diaphragm 212 comes in contact with the back plate 214.

In general, an oscillation frequency f of an LC oscillation circuit is determined by an equation (2) as follows.

$$f = \frac{1}{2\pi\sqrt{LC}} \tag{2}$$

L: coil inductance

C: condenser capacitance

Δf that is a change in f responding to sound pressures is represented by an equation (3) as follows. It is therefore understood that the measures (2) through (4) mentioned above are effective as a measure for increasing the frequency change Δf with the aim of enhancing sensitivity.

$$\Delta f = \frac{\partial f}{\partial C}\Delta C = \frac{f}{2} \times \frac{\Delta C}{C} = \frac{f}{2} \times \frac{\Delta S}{S} \tag{3}$$

C: condenser capacitance

S: area of the back plate 214

A conventional condenser microphone requires a bias voltage Vb of few volts in order to obtain practically viable sensitivity, whereas the chip microphone 240 operating with the oscillation circuit requires only 1 to 2 volts. According to the equation (1), therefore, the present invention can achieve the stability factor μ that is few times to few hundred times as large as that of the conventional microphone, thereby also increasing latitude in selecting a measure for enhancing sensitivity.

In the oscillation/modulation circuit 241, the oscillation frequency f of the LC oscillator changes in response to changes in the condenser capacitance caused by the vibration of the diaphragm 212 relative to the back plate 214 when the diaphragm 212 of the chip microphone 240 responds to changes in sound pressures. The oscillation frequency f is determined by the equation (2) as shown above.

The chip microphone 240 and the oscillation/modulation circuit 241 may be assembled together by connecting separate components, or may be implemented on the same circuit board. Alternatively, they may be formed on the same semiconductor substrate by semiconductor manufacturing technology.

In this manner, this embodiment has additional advantages over the previous embodiments. Namely, the vibration of the diaphragm 212 of the chip microphone 240 is not detected by applying the bias voltage Vb as in the conventional microphones, but is detected through changes in the condenser capacitance by applying a minute voltage no more than necessary for operating the LC circuit of the oscillation/modulation circuit 241. In this manner, audio information conveyed as changes in sound pressures is detected.

Accordingly, even if the adhesive support block 213 of the chip microphone 240 is formed to be as thin as 2 micrometers to 5 micrometers, there is no risk of having the diaphragm 212 and the back plate 214 stuck to each other. This makes it possible to further reduce the size of the audio input portion including the chip microphone 240 as well as the entire apparatus.

Figure 14:
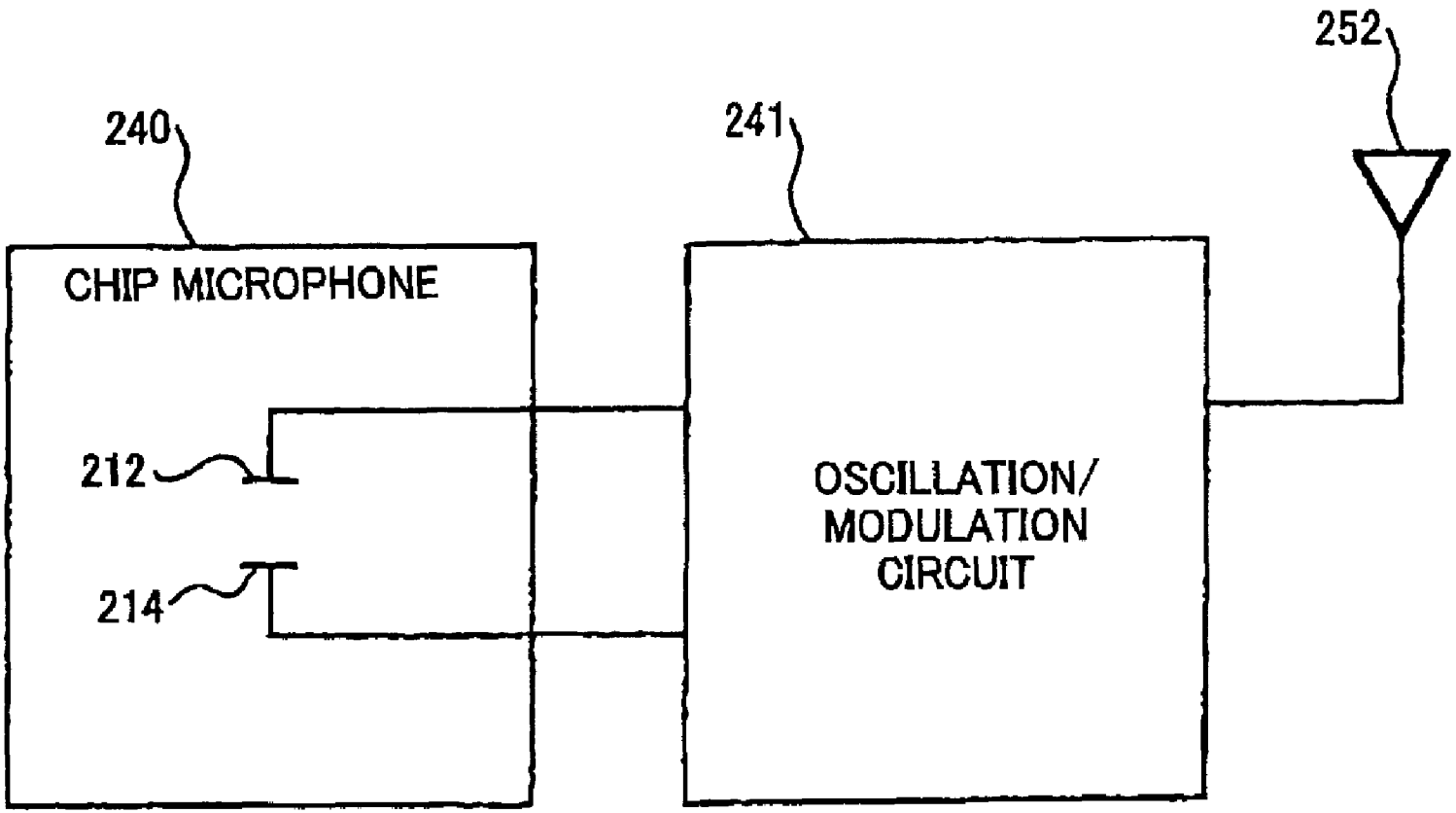
FIG. 14 is a block diagram showing an example of the configuration of an audio transmission apparatus according to a fourth embodiment of the sound processing apparatus of the present invention.

FIG. 14 is a block diagram showing an example of the configuration of an audio transmission apparatus according to a fourth embodiment of the sound processing apparatus of the present invention.

In FIG. 14, the audio transmission apparatus (sound processing apparatus) includes the chip microphone 240 and the oscillation/modulation circuit 241 connected to the chip microphone 240, and further includes an antenna 252 that is attached to the oscillation/modulation circuit 241 in place of the output terminal. The antenna 252 transmits radio waves to the air so that a remote apparatus can receive the radio waves.

The oscillation/modulation circuit 241 detects changes in the condenser capacitance of the chip microphone 240 as changes in the oscillation frequency. These changes in the oscillation frequency are regarded as FM modulations of the carrier frequency, and radio waves are transmitted from the antenna 252. A remote apparatus receiving the radio waves can demodulate the received radio waves to produce audio information. In this manner, the audio transmission apparatus can serve as a wireless microphone.

The antenna 252 may be provided as a separate component to be assembled with the chip microphone 240 and the oscillation/modulation circuit 241 or to be implemented on the same circuit board. Alternatively, the antenna 252 may preferably be provided as a coil antenna formed with the chip microphone 240 and the oscillation/modulation circuit 241 on a single semiconductor substrate by the semiconductor manufacturing technology. This helps to reduce the size of the apparatus.

In this manner, this embodiment has an additional advantage over the previous embodiments in that audio information inputted into the chip microphone 240 can be transmitted to the air as radio waves for reception by a remote apparatus. This achieves to provide for a compact wireless microphone.

Figure 15:
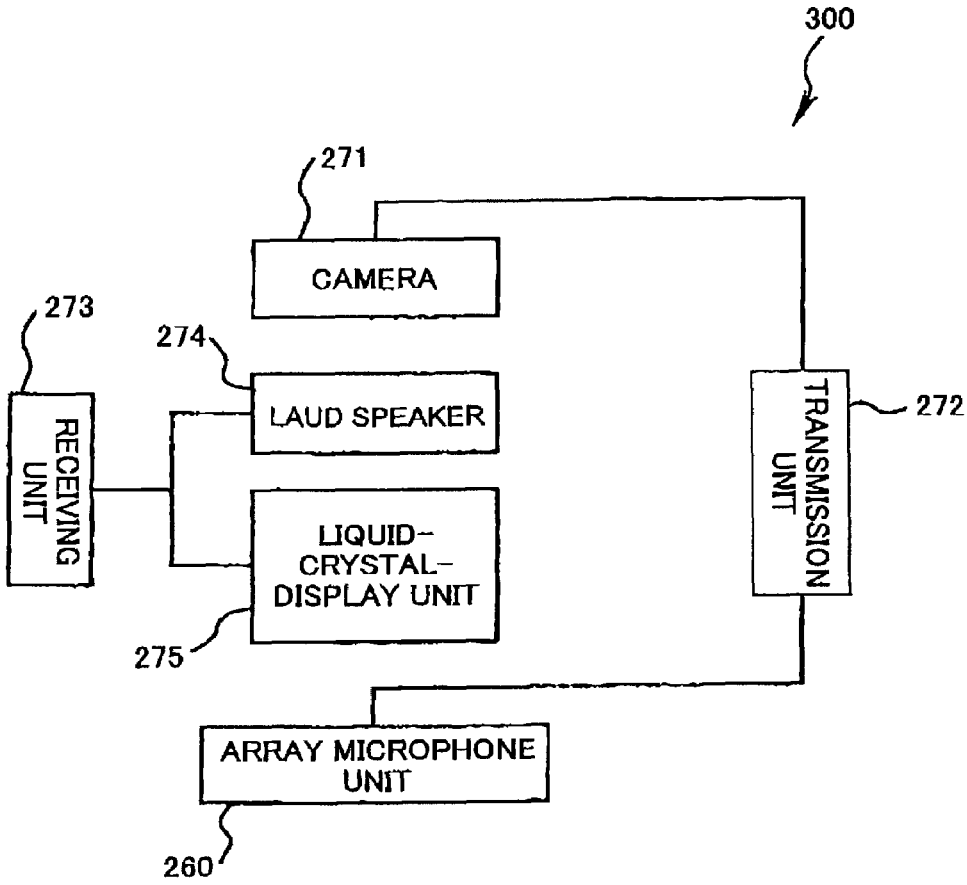
FIG. 15 is a block diagram showing an example of the configuration of an audio transmission apparatus according to a fifth embodiment of the sound processing apparatus of the present invention.
Figure 16:
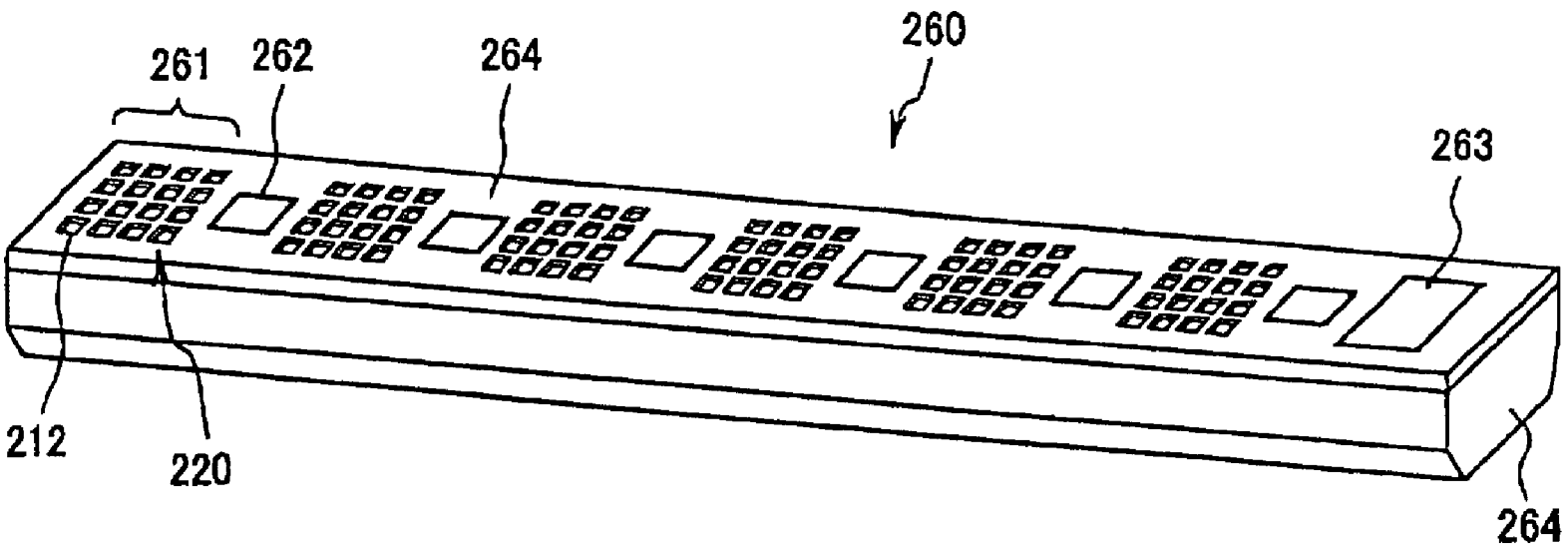
FIG. 16 is an illustrative drawing showing an example of an array microphone unit.
Figure 17:
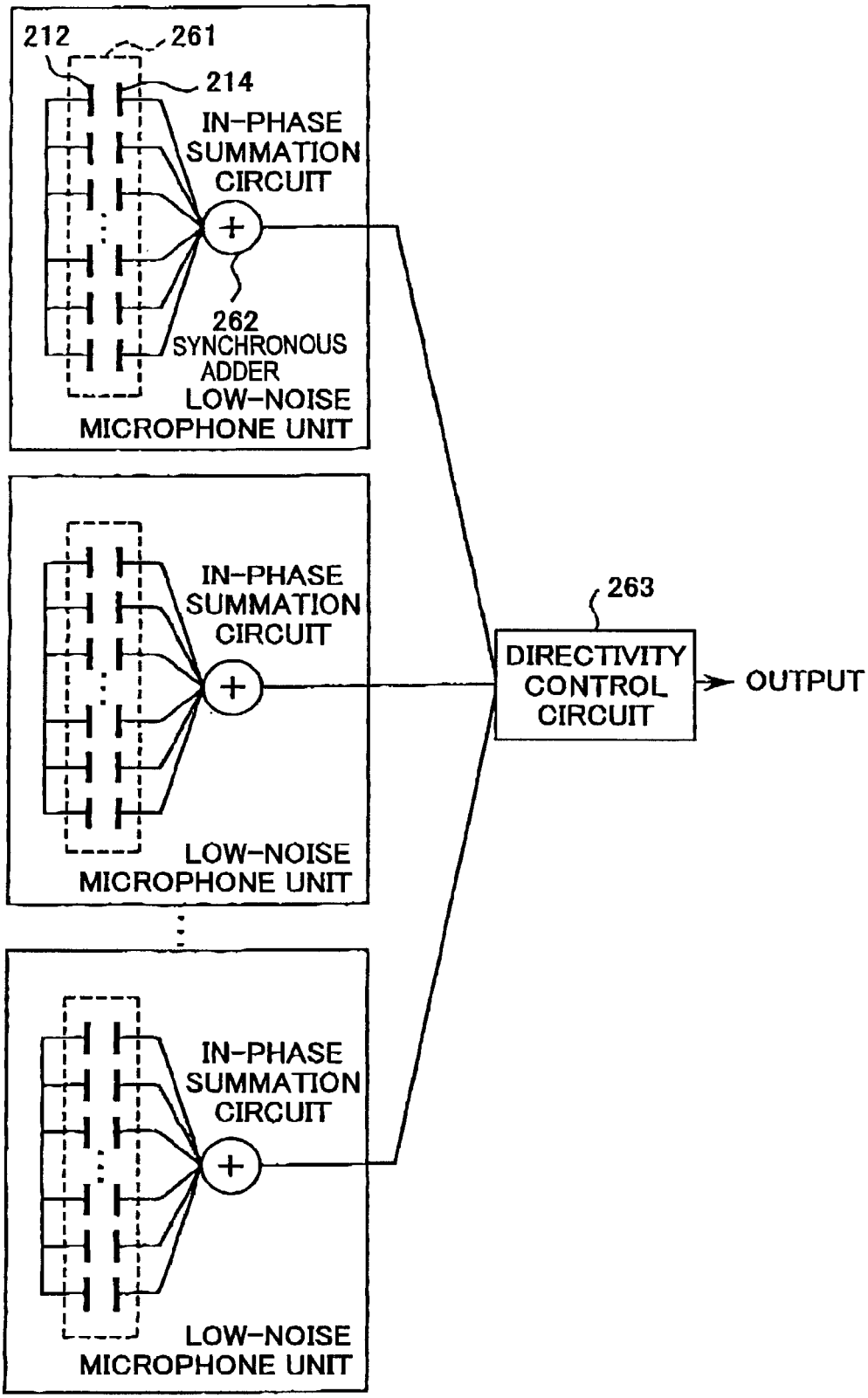
FIG. 17 is a block diagram showing an example of the configuration of the array microphone unit.

FIG. 15 is a block diagram showing an example of the configuration of an audio transmission apparatus according to a fifth embodiment of the sound processing apparatus of the present invention. FIG. 16 is an illustrative drawing showing an example of an array microphone unit, and FIG. 17 is a block diagram showing an example of the configuration of the array microphone unit.

The audio transmission apparatus (sound processing apparatus) of this embodiment includes an array microphone unit 260, which includes array microphones 261 each having a plurality of IC chips 220 arranged in a matrix form. The chip microphone 210 of each of the IC chips 220 acquires audio information, which is then amplified by the amplifier 221 for radio transmission to remote apparatus. The audio transmission apparatus may be incorporated as part of a cellular phone 300 as shown in FIG. 15.

The array microphone unit 260 is housed in the casing of the cellular phone 300, together with other components including a camera 271 for taking video pictures of a caller and the like, a transmission unit 272 for transmitting audio information acquired by the array microphone unit 260 and image information captured by the camera 271 via an antenna (not shown) for reception by a receiver cellular phone, a receiving unit 273 for receiving audio information and image information from the other cellular phone, a laud speaker 274 for producing sounds reproduced from the received audio information, and a liquid-crystal-display unit 275 for displaying the received image information.

The array microphone unit 260 includes an in-phase summation circuit 262 provided for each of the array microphones 261 for the purpose of providing a low-noise microphone through in-phase summation. That is, the in-phase summation circuit 262 adds up n in-phase audio signals that are captured by the chip microphones 210 of the n IC chips 220 and amplified by the amplifiers 221.

Figure 18:
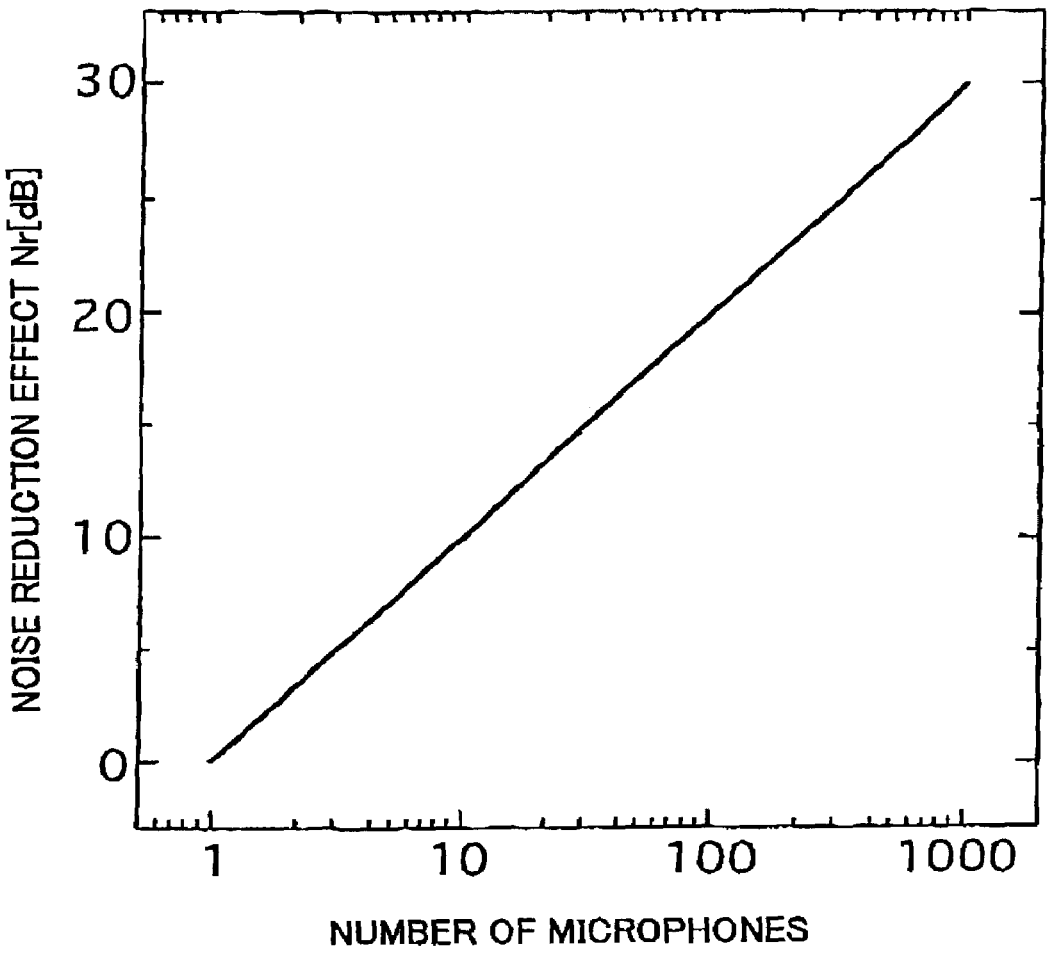
FIG. 18 is a chart showing the relationship between the number of microphones and a noise reduction effect.

The chip microphones 210 of the array microphone 261 end up-picking up noises independent of each other. As described in "Super-Directional Microphone Using Two Dimensional Digital Filter" (Kanamori et al., Acoustical Society of Japan Electrical Acoustics Committee, EA91-84 (1991)), the in-phase summation of signals of the n chip microphones 210 with equal weighting coefficients can produce a noise reduction effect Nr as shown in an equation (4) as follows, assuming that the amplitude characteristics of these noises are identical to each other.

$$Nr=10\log(n)\ [\mathrm{dB}] \tag{4}$$

Where the array microphone 261 includes 16 chip microphones 210, and the in-phase audio signals of these 16 chip microphones 210 are added together, for example, a noise reduction effect of about 12 dB can be obtained according to Nr of the equation (4) FIG. 18 is a chart showing the relationship between the number of microphones and the noise reduction effect Nr.

In order to obtain an in-phase sum for the array microphone 261, outputs of the chip microphones 210 must be substantially in phase. To this end, the size of the array microphone 261 must be much smaller than the wavelength of the sound. The chip microphones 210 can be regarded as being driven in phase by the sound if the array microphone 261 has a side having a length L shorter than 1/10 of the wavelength. By use of the speed of sound c and an upper limit frequency $f_h$ of the frequency range in which noise can be reduced through in-phase summation, the size L of the array microphone 261 needs to satisfy the following condition.

$$L \leq \frac{c}{10 f_h} \tag{5}$$

Figure 19:
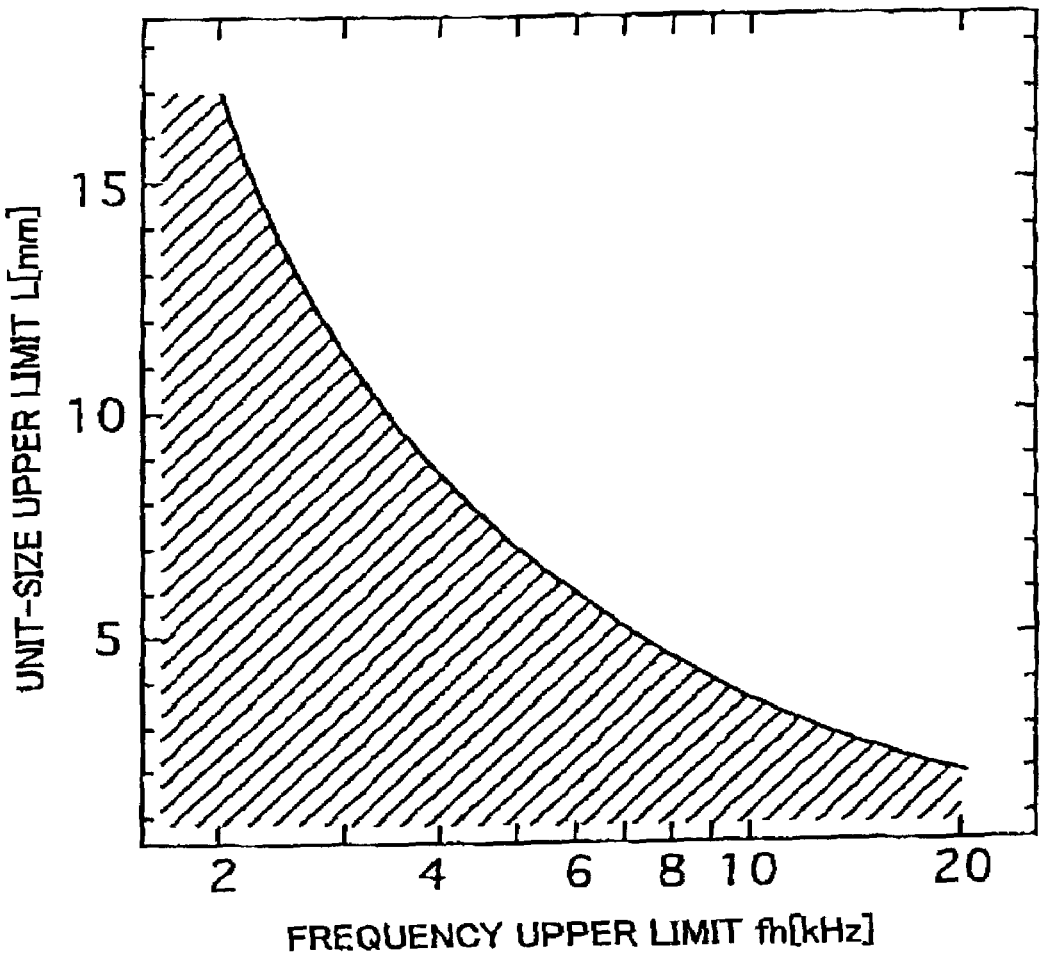
FIG. 19 is a chart showing the conditions that the size of an array microphone needs to satisfy.

When 16 chip microphones 210 are to be arranged in a matrix form to implement the array microphone 261, the size L needs to fall into the hatched area under the characteristic curve in FIG. 19 in order to satisfy the equation (5) where the speed of sound c is set to 340 m/sec. With the upper limit frequency $f_h$ being 8 kHz, the size L has an upper limit of 4 mm. Under this condition, each chip microphone 210 is allowed to have a side length of 1 mm at maximum. Since semiconductor manufacturing technology is employed to produce the chip microphone 210, the size as described above is well within the attainable range.

The array microphone unit 260 has an array structure in which the plurality of array microphones 261 are arranged. The array microphones 261 are connected to a directivity control circuit 263 to form a super-directional microphone, which receives the outputs (sound information) of the array microphones 261 having undergone noise reduction by the in-phase summation, and applies directivity processing that is known in the art. The directivity processing is described in detail, for example, in "Super-Directional Microphone Using Two Dimensional Digital Filter" cited above.

The array microphone unit 260 has an array structure in which six array microphones 261, for example, each having the chip microphones 210 arranged in a matrix, are arranged in an array formation, and the in-phase summation circuit 262 is situated alongside and connected to each array microphone 261, with the outputs of the in-phase summation circuits 262 being all gathered by the directivity control circuit 263. Such an array microphone unit 260 is formed on a single substrate 264 with high precision by a micromachine process based on the semiconductor manufacturing technology, thereby attaining uniform characteristics of the chip microphones 210. In FIG. 16, reference numeral 64 designates a cover case of the array microphone unit 260.

Figure 20:
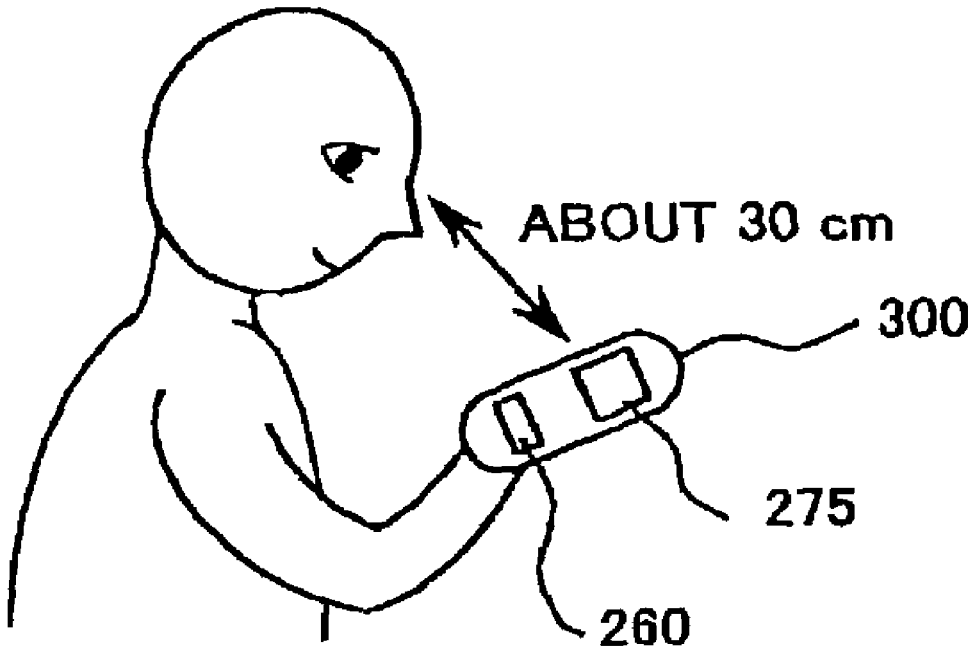
FIG. 20 is an illustrative drawing showing the way a cellular phone according to the present invention is used.

FIG. 20 is an illustrative drawing showing the way the cellular phone 300 is used.

As shown in FIG. 20, the cellular phone 300 having the small-size array microphone unit 260 mounted thereon displays a face of the other person on the liquid-crystal-display unit 275 that is taken a picture of by the camera 271 of the cellular phone at the other end of the line. The caller speaks while watching the liquid-crystal-display unit 275, and the voice coming out of the caller's mouth at a distance from the array microphone unit 260 is captured by the super directivity of the array microphone unit 260, followed by being transmitted to the cellular phone at the other end of the line. In this manner, the caller can engage in conversation in a comfortable manner that does not require the caller to put on a special microphone.

The liquid-crystal-display unit 275 can display any objects instead of the face of the other person, such objects including characters, figures, video images, etc., obtained through broadcast or the Internet. It should be noted that the cellular phone 300 can be used without the display function, allowing the caller to engage in a conversation with a person having no camera function with his/her cellular phone.

In this manner, this embodiment has an additional advantage over the previously described embodiments in that a microphone having a superior directivity can be provided by use of the in-phase summation circuits 262 and the directivity control circuit 263. The array microphone unit 260 may be formed as an integral unit, including the in-phase summation circuits 262, the directivity control circuit 263, the chip microphones 210 having stable characteristics, and the amplifiers 221, by the semiconductor manufacturing technology that achieves a high-precision small-size product. The array microphone unit 260 can be subjected to mass-production by use of the semiconductor manufacturing technology.

This embodiment has been described with reference to a super-directional microphone. It should be noted, however, that the directivity of the microphone can be freely changed from the super-directionality to the omni-directionality by changing processing by the directivity control circuit 263.

Further, the present invention is not limited to these embodiments, but various variations and modifications may be made without departing from the scope of the present invention.

The term "sound processing apparatus" in this application is used to refer to an apparatus for processing sound information with respect to various sounds inclusive of human voice (irrespective of whether they are within the audible range or in the inaudible range). Such sound processing apparatus includes an apparatus such as a cellular phone for transmitting and receiving sound information, an apparatus that records sound information in a record medium such as a cassette tape or a memory chip, an apparatus such as a personal computer that performs voice recognition processing, an apparatus such as a loudspeaker and a hearing aid that amplifies sound signals, an apparatus that applies feedback control to acoustical effects or sound field effects generated by itself by use of a microphone or the like, an apparatus that measures acoustical effects or sound field effects generated by itself by use of a microphone or the like.

Further, the bonding film 113 or the adhesive layer 313 may include high concentration of at least one of the IIIB-family elements in the periodic table such as boron and indium, and the VB-family elements in the periodic table such as phosphorus, arsenic, and antimony.

The present application is based on Japanese priority applications No. 2001-268520 filed on Sep. 5, 2001 and No. 2001-291824 filed on Sep. 25, 2001, with the Japanese Patent Office, the entire contents of which are hereby incorporated by reference.

What is claimed is:

1. A chip microphone implemented as a single silicon-based chip, comprising:

a diaphragm which includes a vibration portion that vibrates in response to sound pressures;

a support block which includes soot silicon oxide as a main component thereof, and is formed on said diaphragm, excluding at least said vibration portion to provide a vibration space; and a back plate which is formed on said support block and over said vibration space, thereby facing said vibration portion of said diaphragm across said vibration space.

2. The chip microphone as claimed in claim 1, further includes a base substrate formed as an integral continuous extension of said diaphragm, said base substrate having an opening that exposes said vibration portion of said diaphragm.

3. The chip microphone as claimed in claim 1, wherein said vibration portion of said diaphragm has through holes formed therethrough.

4. The chip microphone as claimed in claim 1, further comprising:

a first electrode formed on said diaphragm outside a portion where said support block is formed; and a second electrode formed on said back plate.

5. The chip microphone as claimed in claim 1, further comprising a cap that covers said back plate.

6. The chip microphone as claimed in claim 1, wherein said diaphragm, said support block, and said back plate are made of silicon or silicon-based material.

7. The chip microphone as claimed in claim 6, wherein said support block is made of silicon oxide including boron diffused therein.

8. The chip microphone as claimed in claim 6, wherein said diaphragm and said support block are made of an identical material.

9. The chip microphone as claimed in claim 6, wherein said support block includes high concentration of at least one of boron, indium, phosphorus, arsenic, and antimony.

10. The chip microphone as claimed in claim 1, wherein said support block has a thickness substantially between 1 micrometer and 20 micrometers.

11. The chip microphone as claimed in claim 1, wherein said diaphragm includes:

a first portion having a first thickness and serving as said vibration portion; and a second portion having a second thickness thicker than the first thickness.

12. The chip microphone as claimed in claim 11, wherein said first portion is raised relative to an upper surface of said second portion.

13. The chip microphone as claimed in claim 11, wherein said support block includes:

a first portion having a first thickness and situated around said vibration space; and a second portion having a second thickness thicker than the first thickness and situated outside said first portion.

14. A circuit assembly, comprising:

a circuit substrate; and a silicon-based device implemented on said circuit substrate, wherein said silicon-based device includes a microphone comprising:

a diaphragm which includes a vibration portion that vibrates in response to sound pressures;

a support block which includes soot silicon oxide as a main component thereof, and is formed on said diaphragm, excluding at least said vibration portion to provide a vibration space; and a back plate which is formed on said support block and over said vibration space, thereby facing said vibration portion of said diaphragm across said vibration space.

15. The circuit assembly as claimed in claim 14, wherein said microphone is packaged.

16. The circuit assembly as claimed in claim 14, wherein said silicon-based device includes an amplifier formed on a semiconductor substrate together with said microphone.

17. A sound processing apparatus, comprising:

a circuit substrate; and a silicon-based device implemented on said circuit substrate, wherein said silicon-based device includes a microphone comprising:

a diaphragm which includes a vibration portion that vibrates in response to sound pressures;

a support block which includes soot silicon oxide as a main component thereof, and is formed on said diaphragm, excluding at least said vibration portion to provide a vibration space; and a back plate which is formed on said support block and over said vibration space, thereby facing said vibration portion of said diaphragm across said vibration space.

18. The sound processing apparatus as claimed in claim 17, wherein said silicon-based device includes en amplifier formed on a semiconductor substrate together with said microphone.

19. The sound processing apparatus as claimed in claim 17, further comprising:

an A/D-conversion unit which converts analog signals supplied from said microphone into digital signals;

a coding unit which encodes the digital signals to produce encoded signals; and a recording unit which records the encoded signals in a record medium.

20. The sound processing apparatus as claimed in claim 19, wherein said A/D-conversion unit, said coding unit, and said recording unit are implemented on said circuit substrate.

21. The sound processing, apparatus as claimed in claim 19, wherein said A/D-conversion unit is implemented on said circuit substrate.

22. The sound processing apparatus as claimed in claim 19, wherein said A/D-conversion unit and said coding unit are implemented on said circuit substrate.

23. A sound processing apparatus, comprising:

a condenser microphone; and an oscillation/modulation circuit which includes an LC oscillation circuit that oscillates at oscillation frequency determined by a coil and a condenser, said microphone serving as the condenser, wherein said microphone is a silicon-based chip comprising:

a diaphragm which includes a vibration portion that vibrates in response to sound pressures;

a support block which includes soot silicon oxide as a main component thereof, and is formed on said diaphragm, excluding at least said vibration portion to provide a vibration space; and a back plate which is formed on said support block and over said vibration space, thereby facing said vibration portion of said diaphragm across said vibration space.

24. The sound processing apparatus as claimed in claim 23, wherein said support block has a thickness substantially between 2 micrometers and 5 micrometers.

25. A sound processing apparatus, comprising:

an array microphone which includes an array of microphones; and an in-phase summation circuit which is connected to said array microphone to add outputs from said microphones together, wherein said array microphone is implemented as a silicon-based device, and each of said microphones included in said array microphone comprises:

a diaphragm which includes a vibration portion that vibrates in response to sound pressures;

a support block which includes soot silicon oxide as a main component thereof, and is formed on said diaphragm, excluding at least said vibration portion to provide a vibration space; and a back plate which is formed on said support block and over said vibration space, thereby facing said vibration portion of said diaphragm across said vibration space.

26. The sound processing apparatus as claimed in claim 25, further comprising:

a plurality of array microphones identical to said array microphone; and a plurality of in-phase summation circuits, each of which is identical to said in-phase summation circuit, and is connected to a corresponding one of said array microphones to add outputs from said microphones together, wherein said array microphones are formed in said silicon-based device.

27. The sound processing apparatus as claimed in claim 26, further comprising a directivity control circuit which receives outputs of said in-phase summation circuits, and applies directivity processing to the received outputs.

28. A method of making a chip microphone, comprising the steps of:

providing a diaphragm substrate;

providing a back-plate substrate;

bonding the diaphragm substrate and the back-plate substrate together with a bonding layer placed therebetween, the bonding layer including soot silicon oxide as a main component;

forming etching masks on exposed surfaces of the diaphragm substrate and the back-plate substrate;

performing first etching to turn the diaphragm substrate into a diaphragm and a base around the diaphragm and to turn the back-plate substrate into a back plate having through holes; and performing second etching by using the back plate having through holes as an etching mask to remove a portion of the bonding layer, thereby creating a space across which the diaphragm faces the back plate.

29. The method as claimed in claim 28, wherein said step of providing a diaphragm substrate includes the steps of:

providing a diaphragm substrate; and forming an etch-stop layer at a surface of said diaphragm substrate, wherein the bonding layer is attached to the etch-stop layer, and said step of performing first etching removes a portion of the diaphragm substrate so as to expose the etch-stop layer, the diaphragm substrate turning into the base, and the etch-stop layer turning into the diaphragm.

30. The method as claimed in claim 29, wherein said step of forming an etch-stop layer forms the etch-step layer by diffusing high concentration of impurity into the diaphragm substrate.

31. The method as claimed in claim 30, wherein said impurity is boron.

* * * * *